US010661562B2

(12) United States Patent
Jeuté

(10) Patent No.: US 10,661,562 B2
(45) Date of Patent: May 26, 2020

(54) DROP ON DEMAND PRINTING HEAD AND PRINTING METHOD

(71) Applicant: Piotr Jeuté, Warsaw (PL)

(72) Inventor: Piotr Jeuté, Warsaw (PL)

(73) Assignee: Piotr Jeuté, Warsaw (PL)

( * ) Notice: Subject to any disclaimer, the term of this patent is extended or adjusted under 35 U.S.C. 154(b) by 0 days.

(21) Appl. No.: 16/322,944

(22) PCT Filed: Jul. 24, 2017

(86) PCT No.: PCT/EP2017/068563
§ 371 (c)(1),
(2) Date: Feb. 2, 2019

(87) PCT Pub. No.: WO2018/024514
PCT Pub. Date: Feb. 8, 2018

(65) Prior Publication Data

US 2019/0184701 A1 Jun. 20, 2019

(30) Foreign Application Priority Data

Aug. 4, 2016 (GB) ..... 1613430.6
Oct. 31, 2016 (GB) ..... 1618351.9

(51) Int. Cl.
*B41J 2/095* (2006.01)
*B41J 2/105* (2006.01)
(Continued)

(52) U.S. Cl.
CPC ..... *B41J 2/095* (2013.01); *B41J 2/105* (2013.01); *B41J 2/14* (2013.01); *B41J 2/211* (2013.01);
(Continued)

(58) Field of Classification Search
CPC ... B41J 2/095; B41J 2/105; B41J 2/211; B41J 2/14; B41J 2/04526; B41J 2/04535; B41J 2/04503; B41J 2002/14491; B41J 2202/04
See application file for complete search history.

(56) References Cited

U.S. PATENT DOCUMENTS 6,164,748 A * 12/2000 Taneya ..... 347/15
7,380,895 B2 * 6/2008 Sugahara ..... 347/9
(Continued)

FOREIGN PATENT DOCUMENTS

DE 3416449 2/1985
DE 3501905 12/1985
(Continued)

OTHER PUBLICATIONS

PCT International Search Report and Written Opinion in WO2018024514A1.

*Primary Examiner* — Juanita D Jackson
(74) *Attorney, Agent, or Firm* — Soody Tronson; STLG Law Firm

(57) ABSTRACT

A drop-on-demand printing method comprising performing the following steps in a printing head: discharging a first primary drop of a first liquid from a first nozzle outlet to move along a first path (pA) with a first speed; discharging a second primary drop of a second liquid from a second nozzle outlet to move along a second path (pB) with a second speed, lower than the first speed, wherein the second path (pB) is inclined with respect to the first path (pB) along an axis inclined at an angle (α) from 3 to 60 degrees and crosses the first path (pA) at a connection point; controlling the flight of the first primary drop and the second primary drop to combine the first primary drop with the second primary drop into a combined drop at the connection point so that a chemical reaction is initiated between the first liquid of the first primary drop and the second liquid of the second primary drop; applying electric charge to the com-
(Continued)

bined drop; wherein the path of flight (pC) of the combined drop is altered no more than 20 degrees from the axis of the path of flight (pA) of the first primary drop; and controlling the path of flight (pC) of the combined drop with applied electric charge by deflecting electrodes.

28 Claims, 15 Drawing Sheets

(51) Int. Cl.
*B41J 2/14* (2006.01)
*B41J 2/21* (2006.01)

(52) U.S. Cl.
CPC .. *B41J 2002/14491* (2013.01); *B41J 2202/04* (2013.01); *B41J 2202/11* (2013.01)

(56) References Cited

U.S. PATENT DOCUMENTS

| | | | |
|---|---|---|---|
| 2004/0046825 | A1 | 3/2004 | Sugahara |
| 2004/0217186 | A1 | 11/2004 | Sachs et al. |
| 2007/0211098 | A1 | 9/2007 | Pechtl |
| 2007/0236540 | A1 | 10/2007 | Hollands |
| 2010/0105163 | A1 | 4/2010 | Ito et al. |
| 2011/0181674 | A1 | 7/2011 | Kang et al. |

FOREIGN PATENT DOCUMENTS

| | | | |
|---|---|---|---|
| EP | 1024006 | | 8/2000 |
| EP | 1219431 | | 7/2002 |
| EP | 1574343 | A2 | 9/2005 |
| JP | S5658874 | | 10/1979 |
| JP | H03184854 | | 8/1991 |
| JP | H07276629 | | 10/1995 |
| JP | H07314693 | | 12/1995 |
| JP | H11227192 | A | 8/1999 |
| JP | H11227227 | | 8/1999 |
| JP | 2010105163 | | 5/2010 |
| WO | 2008058189 | | 5/2008 |

* cited by examiner

DROP ON DEMAND PRINTING HEAD AND PRINTING METHOD

TECHNICAL FIELD

The present invention relates to drop on demand printing heads and printing methods.

BACKGROUND

Ink jet printing is a type of printing that recreates a digital image by propelling drops of ink onto paper, plastic, or other substrates. There are two main technologies in use: continuous (CIJ) and Drop-on-demand (DOD) inkjet.

In continuous inkjet technology, a high-pressure pump directs the liquid solution of ink and fast drying solvent from a reservoir through a gunbody and a microscopic nozzle, creating a continuous stream of ink drops via the Plateau-Rayleigh instability. A piezoelectric crystal creates an acoustic wave as it vibrates within the gunbody and causes the stream of liquid to break into drops at regular intervals. The ink drops are subjected to an electrostatic field created by a charging electrode as they form; the field varies according to the degree of drop deflection desired. This results in a controlled, variable electrostatic charge on each drop. Charged drops are separated by one or more uncharged "guard drops" to minimize electrostatic repulsion between neighboring drops. The charged drops pass through an electrostatic field and are directed (deflected) by electrostatic deflection plates to print on the receptor material (substrate), or allowed to continue on undeflected to a collection gutter for re-use. The more highly charged drops are deflected to a greater degree. Only a small fraction of the drops is used to print, the majority being recycled. The ink system requires active solvent regulation to counter solvent evaporation during the time of flight (time between nozzle ejection and gutter recycling), and from the venting process whereby gas that is drawn into the gutter along with the unused drops is vented from the reservoir. Viscosity is monitored and a solvent (or solvent blend) is added to counteract solvent loss.

Drop-on-demand (DOD) may be divided into low resolution DOD printers using electro valves in order to eject comparatively big drops of inks on printed substrates, or high resolution DOD printers, may eject very small drops of ink by means of using either a thermal DOD and piezoelectric DOD method of discharging the drop.

In the thermal inkjet process, the print cartridges contain a series of tiny chambers, each containing a heater. To eject a drop from each chamber, a pulse of current is passed through the heating element causing a rapid vaporization of the ink in the chamber to form a bubble, which causes a large pressure increase, propelling a drop of ink onto the paper. The ink's surface tension, as well as the condensation and thus contraction of the vapor bubble, pulls a further charge of ink into the chamber through a narrow channel attached to an ink reservoir. The inks used are usually water-based and use either pigments or dyes as the colorant. The inks used must have a volatile component to form the vapor bubble, otherwise drop ejection cannot occur.

Piezoelectric DOD use a piezoelectric material in an ink-filled chamber behind each nozzle instead of a heating element. When a voltage is applied, the piezoelectric material changes shape, which generates a pressure pulse in the fluid forcing a drop of ink from the nozzle. A DOD process uses software that directs the heads to apply between zero to eight drops of ink per dot, only where needed.

High resolution printers, alongside the office applications, are also being used in some applications of industrial coding and marking. Thermal Ink Jet more often is used in cartridge based printers mostly for smaller imprints, for example in pharmaceutical industry. Piezoelectric printheads of companies like Spectra or Xaar have been successfully used for high resolution case coding industrial printers.

All DOD printers share one feature in common: the discharged drops of ink have longer drying time compared to CIJ technology when applied on non porous substrate. The reason being usage of fast drying solvent, which is well accepted by CIJ technology designed with fast drying solvent in mind, but which usage needs to be limited in DOD technology in general and high resolution DOD in particular. That is because fast drying inks would cause the dry back on the nozzles. In most of known applications the drying time of high resolution DOD printers' imprints on non porous substrates would be at least twice and usually well over three times as long as that of CIJ. This is a disadvantage in certain industrial coding applications, for instance very fast production lines where drying time of few seconds may expose the still wet (not dried) imprint for damage when it gets in contact with other objects.

Another disadvantage of high resolution DOD technology is limited drop energy, which requires the substrate to be guided very evenly and closely to printing nozzles. This also proves to be disadvantageous for some industrial applications. For example when coded surface is not flat, it cannot be guided very close to nozzles.

CIJ technology also proves to have inherent limitations. So far CIJ has not been successfully used for high resolution imprints due to the fact that it needs certain drop size in order to work well. The other well-known disadvantage of CIJ technology is high usage of solvent. This causes not only high costs of supplies, but also may be hazardous for operators and the environment, since most efficient solvents are poisonous, such as the widely used MEK (Methyl Ethyl Ketone).

The following documents illustrate various improvements to the ink jet printing technology.

An article "Double-shot inkjet printing of donor-acceptor-type organic charge-transfer complexes: Wet/nonwet definition and its use for contact engineering" by T. Hasegawa et al (Thin Solid Films 518 (2010) pp. 3988-3991) presents a double-shot inkjet printing (DS-IJP) technique, wherein two kinds of picoliter-scale ink drops including soluble component donor (e.g. tetrathiafulvalene, TTF) and acceptor (e.g. tetracyanoquinodimethane, TCNQ) molecules are individually deposited at an identical position on the substrate surfaces to form hardly soluble metal compound films of TTF-TCNQ. The technique utilizes the wet/nonwet surface modification to confine the intermixed drops of individually printed donor and acceptor inks in a predefined area, which results in the picoliter-scale instantaneous complex formation.

A U.S. Pat. No. 7,429,100 presents a method and a device for increasing the number of ink drops in an ink drop jet of a continuously operating inkjet printer, wherein ink drops of at least two separately produced ink drop jets are combined into one ink drop jet, so that the combined ink drop jet fully encloses the separate ink drops of the corresponding separate ink drop jets and therefore has a number of ink drops equal to the sum of the numbers of ink drops in the individual stream. The drops from the individual streams do not collide with each other and are not combined with each other, but remain separate drops in the combined drop jet.

A US patent application US20050174407 presents a method for depositing solid materials, wherein a pair of inkjet printing devices eject ink drops respectively in a direction such that they coincide during flight, forming mixed drops which continue onwards towards a substrate, wherein the mixed drops are formed outside the printing head.

A U.S. Pat. No. 8,092,003 presents systems and methods for digitally printing images onto substrates using digital inks and catalysts which initiate and/or accelerate curing of the inks on the substrates. The ink and catalyst are kept separate from each other while inside the heads of an inkjet printer and combine only after being discharged from the head, i.e. outside the head. This may cause problems in precise control of coalescence of the drops in flight outside the head and corresponding lack of precise control over drop placement on the printed object.

A Japanese patent application JP2010105163A discloses a nozzle plate that includes a plurality of nozzle holes that discharge liquids that combine in flight outside the nozzle plate.

A U.S. Pat. No. 8,092,003 presents systems and methods for digitally printing images onto substrates using digital inks and catalysts which initiate and/or accelerate curing of the inks on the substrates. The ink and catalyst are kept separate from each other while inside the heads of an inkjet printer and combine only after being discharged from the head, i.e. outside the head. This may cause problems in precise control of coalescence of the drops in flight outside the head and corresponding lack of precise control over drop placement on the printed object.

In all of the above-mentioned methods, the drops of respective primary liquids are not guided after being discharged from respective nozzles. Therefore, their path of flight on their way towards the point of connection where they start to form a mixed, combined drop, is not controlled. Such control may become necessary when mixing chemically reacting substrates in order to avoid accidental and undesired contact between substrates in the area of nozzle endings, where such too early contact might lead to residue build up of the combined substance and blocking the nozzle with time while the combined substance solidifies.

A PCT application WO2016135294A2 discloses a drop-on-demand printing method comprising performing the following steps in a printing head: discharging a first primary drop of a first liquid to move along a first path; discharging a second primary drop of a second liquid to move along a second path; controlling the flight of the first primary drop and the second primary drop to combine the first primary drop with the second primary drop into a combined drop at a connection point within a reaction chamber within the printing head so that a chemical reaction is initiated within a controlled environment of the reaction chamber between the first liquid of the first primary drop and the second liquid of the second primary drop; and controlling the flight of the combined drop through the reaction chamber along a combined drop path such that the combined drop, during movement along the combined drop path starting from the connection point is distanced from the elements of the printing head. In one of the embodiments, the printing head comprises a set of electrodes for altering the path of flight of the second primary drop to a path being in line with the path of flight of the first primary drop before or at the connection point.

There are known various arrangements for altering the velocity of the drop exiting the printing head by using electrodes for affecting charged drops, as described e.g. in patent documents U.S. Pat. No. 3,657,599, US20110193908 or US20080074477.

The US patent application US20080074477 discloses a system for controlling drop volume in continuous ink-jet printer, wherein a succession of ink drops, all ejected from a single nozzle, are projected along a longitudinal trajectory at a target substrate. A group of drops is selected from the succession in the trajectory, and this group of drops is combined by electrostatically accelerating upstream drops of the group and/or decelerating downstream drops of the group to combine into a single drop.

German patent applications DE3416449 and DE350190 present CIJ printing heads comprising drop generators which generate a continuous stream of drops, some of which combine into a combined drop. The stream of drops is generated as a result of periodic pressure disturbances in the vicinity of the nozzles that decompose the emerging inkjets to drops which have the same size and are equally spaced. The majority of drops are charged and are collected by gutters and fed back to the reservoirs supplying ink to the drop generators, as common in the CIJ technology. The core features of the printing head related to the CIJ technology make it inherently limited with respect to the DOD technology. A combined drop is formed of non-charged drops and is directed towards the surface to be printed according to a path of movement which depends on the paths of movement of the colliding primary drops.

A Japanese patent application JPS5658874 presents a CIJ printing head comprising nozzles generating continuous streams of drops, which are equally spaced, wherein some of the drops are collected by gutters and only some of the drops reach the surface to be printed. The core features of the printing head related to the CIJ technology make it inherently limited with respect to the DOD technology. The paths of charged primary drops are altered by a set of electrodes such that the path of one drop is altered to cross the path of another drop, so that the drops concentrate at the surface to be printed. A combined drop is therefore formed directly at the surface to be printed.

Due to substantial structural and technological differences between the CIJ and DOD technology print heads, these print heads are not compatible with each other and individual features are not transferrable between the technologies.

A U.S. Pat. No. 8,342,669 discloses an ink set comprising at least two inks, which can be mixed at any time (as listed: before jetting, during jetting, or after jetting). A particular embodiment specifies that the inks may be mixed or combined anywhere between exiting the ink jet head and the substrate, that is, anywhere in flight. After combination of the inks between the ink jetting device and the substrate, the drops of the inks may begin to react, that is polymerization of the vinyl monomers may begin and momentum of the drops may carry the drops to a desired location on the substrate. This has, however, the disadvantage, that it is difficult to control the parameters of coalescence of the drops, as it the surrounding outside the ink jetting device is variable.

It would be desirable to control the path of flight of the primary substrate drops after they leave their respective nozzle outlets not only to ensure the appropriate coalescence, but also in order to avoid too early contact between chemically reacting substrates in the proximity of nozzle outlets. Such undesired contact might lead to the reacted substance residue build up and consequently to the nozzle clogging.

A US patent application US2011/0181674 discloses an inkjet print head including a pressure chamber storing a first ink drawn in from a reservoir and transferring the first ink to a nozzle by a driving force of an actuator; and a damper disposed between the pressure chamber and the nozzle and allowing the first ink to be mixed with a second ink drawn through an ink flow path for the second ink. The disadvantage of that solution is that the mixed ink is in contact with the nozzle. This can lead to problems when the physicochemical parameters of the mixed ink do not allow for jetting of the mixed ink, or the mixed ink is not chemically stable and reactions occurring within the mixed ink cause the change of physicochemical parameters that do not allow for jetting of the mixed ink, or the reaction causes solidification of the mixed ink. In case the chemical reaction is initiated while mixing the ink components, any residue of the mixed ink which gets in contact with the nozzle may cause the residue build up, leading to clogging the nozzle during printing process.

The problem associated with DOD inkjet printing is the relatively long time of curing of the ink after its deposition on the surface remains actual.

There is still a need to improve the DOD inkjet printing technology in order to shorten the time of curing of the ink after its deposition on the surface. In addition, it would be advantageous to obtain such result combined with higher drop energy and more precise drop placement in order to code different products of different substrates and shapes. There is a need to improve the inkjet print technologies in attempt to decrease the drying (or curing) time of the imprint and to increase the energy of the printing drop being discharged from the printer. The present invention combines those two advantages and brings them to the level available so far only to CIJ printers and unavailable in the area of DOD technology in general (mainly when it comes to drying time) and high resolution DOD technology in particular, where both drying (curing) time and drop energy have been have been very much improved compared to the present state of technology. The present invention addresses also the main disadvantages of CIJ technology leading to min. 10 times reduction of solvent usage and allowing much smaller—compared to those of CIJ—drops to be discharged with higher velocity, while the resulting imprint could be consolidated on the wide variety of substrates still in a very short time and with very high adhesion.

There is also a need to provide an alternative solution for controlling the flight of the printing drops, with alternative means for controlling the path of flight of the printing drops, and with an aim to improve drop placement accuracy, drop size selection and print resolution. Such alternative solution should preferably enable to apply the above mentioned improvements on a wide range of different substrates by means of using wide range of inks including inks allowing the combination of very high adhesion, very high print resolution and drop placement accuracy i.e. print quality and a very short drying or solidifying time, i.e the time between the moment of placing the drop on the substrate and the moment of readymade, dry, solid, permanent imprint creation on the substrate.

SUMMARY

In a first aspect, there is disclosed a drop-on-demand printing method comprising performing the following steps in a printing head: discharging a first primary drop of a first liquid from a first nozzle outlet to move along a first path (pA) with a first speed; discharging a second primary drop of a second liquid from a second nozzle outlet to move along a second path (pB) with a second speed, lower than the first speed, wherein the second path (pB) is inclined with respect to the first path (pB) along an axis inclined at an angle ($\alpha$) from 3 to 60 degrees and crosses the first path (pA) at a connection point; controlling the flight of the first primary drop and the second primary drop to combine the first primary drop with the second primary drop into a combined drop at the connection point so that a chemical reaction is initiated between the first liquid of the first primary drop and the second liquid of the second primary drop; applying electric charge to the combined drop; wherein the path of flight (pC) of the combined drop is altered no more than 20 degrees from the axis of the path of flight (pA) of the first primary drop; and controlling the path of flight (pC) of the combined drop with applied electric charge by deflecting electrodes.

The first primary drop may have at the connection point a kinetic energy higher than the second primary drop.

The method may comprise applying electric charge to the combined drop by charging at least one of: the first primary drop and the second primary drop.

The method may comprise charging at least one of: the first primary drop and the second primary drop between the nozzle outlet and the connection point.

The method may comprise charging at least one of: the first primary drop and the second primary drop at the nozzle outlet while the primary drop is in contact with the liquid within the nozzle channel.

The method may further comprise deflecting the path of flight (pA, pB) of the charged primary drop by deflecting electrodes.

The method may further comprise accelerating the charged combined drop by accelerating electrodes.

The method may comprise applying electric charge to the combined drop by charging the combined drop in flight.

The method may comprise discharging the first primary drop of a size larger than the second primary drop.

The method may comprise controlling the timing of discharge of the primary drops.

The method may comprise controlling the relative position of the nozzle outlets.

The connection point can be located within a reaction chamber defined by a cover.

The method may further comprise controlling at least one of the following parameters within the reaction chamber: chamber temperature, electric field, ultrasound field, UV light, the stream of gas directed towards the printing head enclosure outlet.

There is also disclosed a drop-on-demand printing head comprising: a nozzle assembly comprising: a first nozzle connected through a first channel with a first liquid reservoir with a first liquid and having a first drop generating and propelling device for forming on demand a first primary drop of the first liquid and discharging the first primary drop to move along a first path (pA) with a first speed; and a second nozzle connected through a second channel with a second liquid reservoir with a second liquid and having a second drop generating and propelling device for forming on demand a second primary drop of the second liquid and discharging the second primary drop to move along a second path (pB) with a second speed, lower than the first speed, wherein the second path (pB) is inclined with respect to the first path (pB) along an axis inclined at an angle ($\alpha$) from 3 to 60 degrees and crosses the first path (pA) at a connection point; means for controlling the flight of the first primary drop and the second primary drop to combine the first primary drop with the second primary drop into a combined drop at the connection point so that a chemical reaction is initiated between the first liquid of the first primary drop and the second liquid of the second primary drop; means for applying electric charge to the combined drop; wherein the path of flight (pC) of the combined drop is altered no more than 20 degrees from the axis of the path of flight (pA) of the first primary drop; and deflecting electrodes for controlling the path of flight (pC) of the combined drop.

The first primary drop may have at the connection point a kinetic energy higher than the second primary drop.

The printing head may comprise charging electrodes for charging at least one of: the first primary drop and the second primary drop.

The charging electrodes can be positioned between the nozzle outlet and the connection point.

The charging electrodes can be located at the nozzle outlet to charge the primary drop while the primary drop is in contact with the liquid within the nozzle channel.

The printing head may further comprise deflecting electrodes for deflecting the path of flight (pA, pB) of the charged primary drop.

The printing head may further comprise accelerating electrodes for accelerating the charged combined drop.

The printing head may further comprise charging electrodes for applying electric charge to the combined drop by charging the combined drop in flight.

The first primary drop may have a size larger than the second primary drop.

The printing head may further comprise a controller for controlling the timing of discharge of the primary drops.

The printing head may further comprise means for controlling the relative position of the nozzle outlets.

The connection point can be located within a reaction chamber defined by a cover.

In a second aspect there is disclosed a drop-on-demand printing method comprising performing the following steps in a printing head: discharging a first primary drop of a first liquid having a first electric charge to move along a first path; discharging a second primary drop of a second liquid having a second electric charge which is opposite to the first charge to move along a second path; wherein the first charge and the second charge are selected such that the primary drops attract each other in flight and combine to form a combined drop at a connection point before reaching the printed surface.

The method may comprise discharging the first primary drop from a first nozzle outlet and discharging the second primary drop from a second nozzle outlet, wherein the first nozzle outlet is separated from the second nozzle outlet by a distance, measured between the nozzle axes in the plane of the nozzle outlets, which is larger than the diameters of the primary drops exiting the nozzle outlets.

The method may comprise discharging the first primary drop from a first nozzle outlet which is separated by a separator, having a downstream-narrowing cross-section, from a second nozzle outlet from which the second primary drop is discharged.

The method may further comprise controlling the path of flight of the primary drops by streams of gas.

The connection point can be located within a reaction chamber defined by a cover.

The first liquid can be an ink base and the second liquid is a catalyst for curing the ink base.

The first liquid and the second liquid may undergo a chemical reaction within the combined drop.

The first liquid and the second liquid may have an interface surface tension selected to allow the liquids to coalesce in flight and diffuse to form the combined drop, so that a chemical reaction is initiated immediately after coalescence of primary drops.

The method may further comprise controlling at least one of the following parameters within the reaction chamber: chamber temperature, electric field, ultrasound field, UV light.

The method may comprise charging the liquids within the liquid reservoirs.

The method may comprise charging the liquids outside the liquid reservoirs.

The method may comprise charging the primary drops along their path of flight between the nozzle outlets and the connection point.

There is also disclosed a drop-on-demand printing head comprising: a nozzle assembly comprising: a first nozzle connected through a first channel with a first liquid reservoir with a first liquid and having a first drop generating and propelling device for forming on demand a first primary drop of the first liquid and discharging the first primary drop to move along a first path; and a second nozzle connected through a second channel with a second liquid reservoir with a second liquid and having a second drop generating and propelling device for forming on demand a second primary drop of the second liquid and discharging the second primary drop to move along a second path; means for charging the first liquid forming the first primary drop with a first charge; means for charging the second liquid forming the second primary drop with a second charge which is opposite to the first charge; wherein the first charge and the second charge are selected such that the primary drops attract each other in flight and combine to form a combined drop at a connection point before reaching the printed surface.

The first liquid can be an ink base and the second liquid can be a catalyst for curing the ink base.

The first liquid and the second liquid may undergo a chemical reaction within the combined drop.

The first liquid and the second liquid may have an interface surface tension selected to allow the liquids to coalesce in flight and diffuse to form the combined drop, so that a chemical reaction is initiated immediately after coalescence of primary drops.

The first nozzle outlet can be separated from the second nozzle outlet by a distance, measured between the nozzle axes in the plane of the nozzle outlets, which is larger than the diameters of the primary drops exiting the nozzle outlets.

The first primary drop can be discharged from a first nozzle outlet which is separated by a separator, having a downstream-narrowing cross-section, from a second nozzle outlet from which the second primary drop is discharged.

The length of the side wall of the separator, from the plane of the nozzle outlet ending, is not shorter than the diameter of the primary drop.

The printing head may further comprise a cover enclosing the nozzle outlets and the connection point.

The liquid reservoirs, the nozzles and nozzle outlets can be separated by an electrically isolating plate forming a sharp ended separator between the nozzle outlets.

The nozzle outlets can be configured to discharge the primary drops in parallel to each other.

The printing head may further comprise means for controlling the path of flight of the combined drop.

The printing head may further comprise charging plates downstream the paths of flight of the primary drops, between the nozzle outlets and the connection point; a first DC voltage source connected between the first nozzle outlet and the first charging plate; a second DC voltage source connected between the second nozzle outlet and the second charging plate; wherein the second charging plate is connected to an electric potential opposite to the first charging plate; an electrically insulating separator plate between the nozzle outlets, and between the charging plates.

The first charging plate can be separated from the first nozzle outlet by a first electrically insulating separator and the second charging plate is separated from the second nozzle outlet by a second electrically insulating separator.

The printing head can further comprise a source of gas stream configured to generate first streams of gas between the electrically insulating separator and the nozzles and second streams of gas between the charging plates and the nozzles.

The printing head can further comprise a source of gas stream configured to generate third streams of gas between the charging plates and an enclosure between the nozzle outlets and the connection point.

BRIEF DESCRIPTION OF DRAWINGS

The invention is shown by means of exemplary embodiment on a drawing, in which.

DETAILED DESCRIPTION

Figure 1:
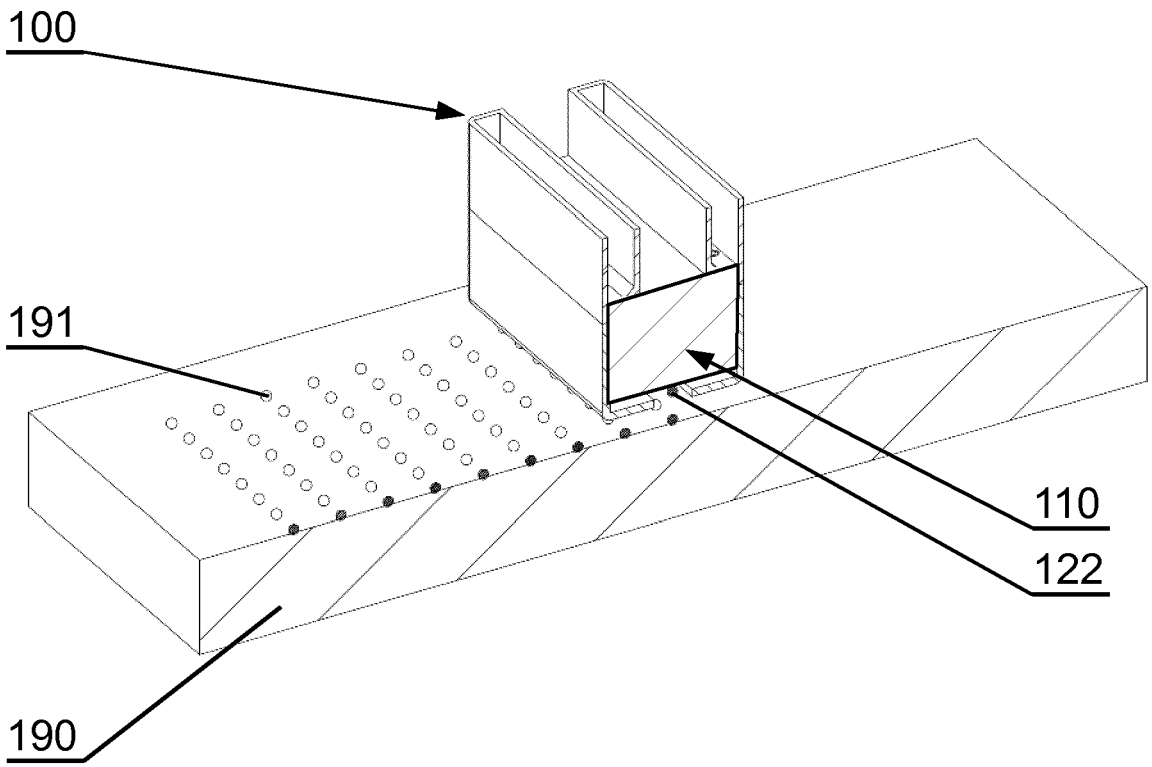
FIG. 1 shows schematically an overview of the printing head.

The details and features of the present invention, its nature and various advantages will become more apparent from the following detailed description of the preferred embodiments of a drop on demand printing head and printing method.

The present invention allows to shorten the time of curing of the ink after its deposition on the surface, by allowing to use fast-curing components which come into chemical reaction in a reaction chamber within the printing head, thereby increasing the efficiency and controllability of the printing process. In other words, the invention provides coalescence in controlled environment.

In the printing head according to the invention, the primary drops can combine into a combined drop wherein a chemical reaction is initiated, without the risk of clogging of the reaction chamber or the outlet of reaction chamber. Preferably, the primary drops combine into the combined drop within the reaction chamber (in the controlled and predictable environment of the printing head, but they may also combine outside the printing head, just before contacting the printed surface. This is achieved by charging the primary drops with opposite charges, so that the primary drops can attract each other and coalesce in flight.

The reaction chamber preferably has at the connection point, wherein the combined drop is formed, a size larger than the size of the expected size of the combined drop, such as to allow good coalescence of the primary drops and prevent the combined drop from touching the walls of the reaction chamber. At the connection point, there is therefore some space available for the primary drops to freely combine.

A chemical reaction is initiated between the component(s) of the first liquid forming the first primary drop and the component(s) of the second liquid forming the second primary drop when the primary drops coalesce to form the combined drop. A variety of substances may be used as components of primary drops. The following examples are to be treated as exemplary only and do not limit the scope of the invention:

- a combined drop of polyacrylate may be formed by chemical reaction between the primary drop of a monomer (for example: methyl methacrylate, ethyl methacrylate, propyl methacrylate, butyl methacrylate optionally with addition of colorant) and the second primary drop of an initiator (for example: catalyst such as trimethylolpropane, tris(1-aziridinepropionate) or azaridine, moreover UV light may be used as initiator agent)
- a combined drop of polyurethane may be formed by chemical reaction between the primary drop of a monomer (for example: methylene diphenyl diisocyanate (MDI), such as 4,4'-methylenediphenyl diisocyanate, or toluene diisocyanate (TDI) or different monomeric diisocyianates either aliphatic or cycloaliphatic) and the second primary drop of an initiator (for example: monohydric alcohol, dihydric alcohol or polyhydric alcohol such as glycerol or glycol; thiols, optionally with addition of colorant)
- a combined drop of polycarboimide may be formed by reaction between the primary drop of a monomer (for example: carbimides) and the second primary drop of an initiator (for example dicarboxylic acids such as adipic acid, optionally with addition of colorant)

In general, the first liquid may comprise a first polymer-forming system (preferably, one or more compounds such as a monomer, an oligomer (a resin), a polymer etc., or a mixture thereof) and the second liquid may comprise a second polymer-forming system (preferably, one or more compounds such as a monomer, an oligomer (a resin), a polymer, an initiator of a polymerization reaction, one or more crosslinkers etc., or a mixture thereof). The chemical reaction is preferably a polyreaction or copolyreaction, which may involve crosslinking, such as polycondensation, polyaddition, radical polymerization, ionic polymerization or coordination polymerization. In addition, the first liquid and the second liquid may comprise other substances such as solvents, dispersants etc.

In general, it is highly preferable that the liquids are selected such that both liquids have a similar and low dynamic viscosity, preferably below 50 mPa*s (cps).

Both liquids shall be selected such as not to form an explosive mixture in the air.

Both liquids shall have an interface surface tension selected to allow the liquids to coalesce in flight and diffuse to form the combined drop, so that a chemical reaction is initiated immediately after coalescence of primary drops. Additives, such as surfactants, may be added to the liquids to lower the interface surface tension.

Particularly good results were obtained for the first liquid being methylene diphenyl diisocyanate (MDI) (which may comprise a pigment) and the second liquid being ethanolamine. A combined drop formed from these liquids coagulated by the way of chemical reaction in about 1 second or shorter.

By controlling the environment of the reaction chamber, it is possible to achieve controllable, full coalescence of the primary drops (which occurs only at particular conditions, dependent on the liquids, such as the speed, mass of drops, the surface tension, viscosity, angle of incidence). It is typically not possible to control these parameters at the environment outside the printing head, where the ambient temperature, pressure, humidity, wind (or any air movement) speed as well as any contaminating particles in the air may vary and have significant impact on the coalescence process. That could also result in deviation of the paths of flight of the drops, bouncing off of the primary drops, which may lead to at least loss of quality, if not to full malfunction of the printing process).

By increasing the temperature within the printing head, the surface tension and viscosity of the primary drops can be reduced.

If the coalescence process is under control, the chemical reaction may be initiated evenly within the volume of the combined drop, thereby providing prints of predictable quality. The liquids of the primary drops coalesce by mechanical manner (due to collision between the drops) and mix by diffusion of the components. The speed of diffusion depends on the difference of concentration of components in the individual drops and the temperature-dependent diffusion coefficient. As the temperature is increased, the diffusion coefficient increases, and the speed of diffusion of the components within the combined drop increases. Therefore, increase of temperature leads to combined drops of more even composition and increases the speed of the chemical reaction.

If the combined drop is formed such that it has a temperature higher than the temperature of the surface to be printed, the combined drop, when it hits the printed surface, undergoes rapid cooling, and its viscosity increases, therefore the drop is less prone to move away from the position at which it was deposited. This cooling process should increase the density and viscosity of the combined drop while deposited, however not to the final solidification stage, since the final solidification should result from completed chemical reaction rather than temperature change only. Moreover, as the chemical reaction (i.e. polymerization, curing (crosslinking)) is already initiated in the combined drop, the crosslinking of individual layers of printed matter is improved (which is particularly important for 3D printing).

The presented solution allows to prevent remnants of combined, reacting substance to build up in the proximity of nozzle outlets by means of controlling the path of flight of primary drops after they are discharged from respective nozzle outlets.

The presented drop-on-demand printing head and method can be employed for various applications, including high-quality printing, even on non-porous substrates or surfaces with limited percolation. Very good adhesion of polymers combined with comparatively high drop energy allows for industrial printing and coding with high speeds on a wide variety of products in the last phase of their production process. The control of the gradual solidification, which includes the preliminary density increase allowing the drop to stay where applied, but at the same time allowing the chemical reaction to get completed before the final solidification, makes this technology suitable for advanced 3D printing. The crosslinking between individual layers would allow to avoid anisotropy kind of phenomena in the final 3D printed material, which would be advantageous compared to the great deal of existing 3D ink jet based technology.

The presented printing head and method combines features and advantages of both CIJ and DOD technologies in a single solution. That solution is superior as compared to existing industrial printers in terms of features such as speed, printed area, drop placement accuracy, ink selection and adhesion to different substrates, print resolution and hazardous solvents use reduction. The presented printing head and method may be therefore considered as a DOD-type improved by advantages available so far only in CIJ technology.

A plurality of embodiments of the present invention will be described below.

Summary of Embodiments

The embodiments first, second, third and fourth relate to at least the second aspect corresponding at least to claims 27-53, and address at least the problems to improve the DOD inkjet printing technology in order to shorten the time of curing of the ink after its deposition on the surface, and to decrease the drying (or curing) time of the imprint and to increase the energy of the printing drop being discharged from the printer.

The embodiments fifth, sixth, seventh and eighth relate to at least the first aspect corresponding at least to claims 1-26 and address at least the problem to improve existing industrial printers in terms of features such as speed, printed area, drop placement accuracy, ink selection and adhesion to different substrates, print resolution and hazardous solvents use reduction.

All embodiments share at least the feature that at least one of the primary drops is charged before the connection point.

The presented printing head and method may be therefore considered as a DOD-type improved by advantages available so far only in CIJ technology.

An example of the inkjet printing head common to all embodiments is shown in an overview in FIG. 1 and in a detailed cross-sectional views in the further figures specific to a particular embodiment.

First Embodiment

Figure 2:
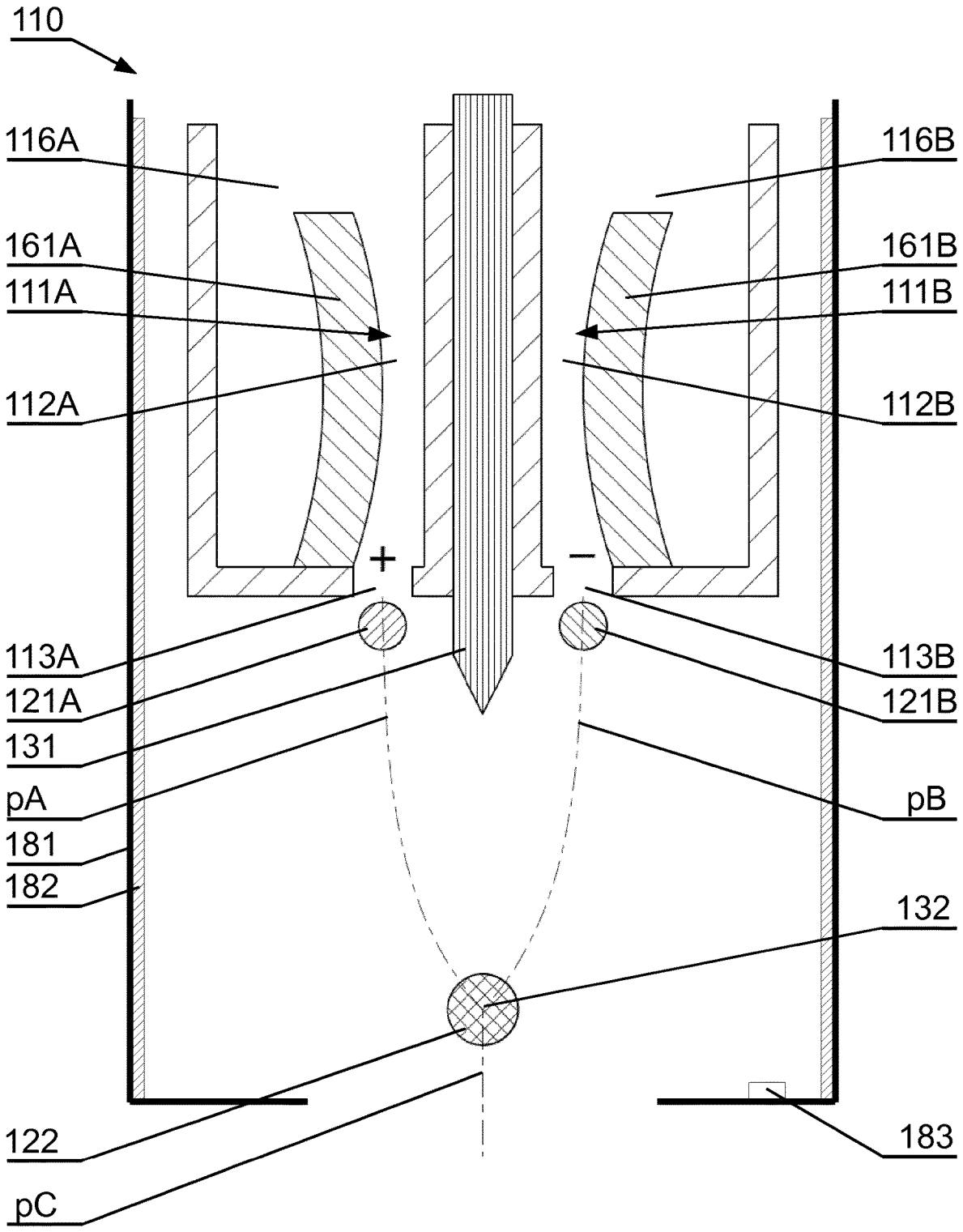
FIG. 2 shows schematically a first variant of a first embodiment.
Figure 3:
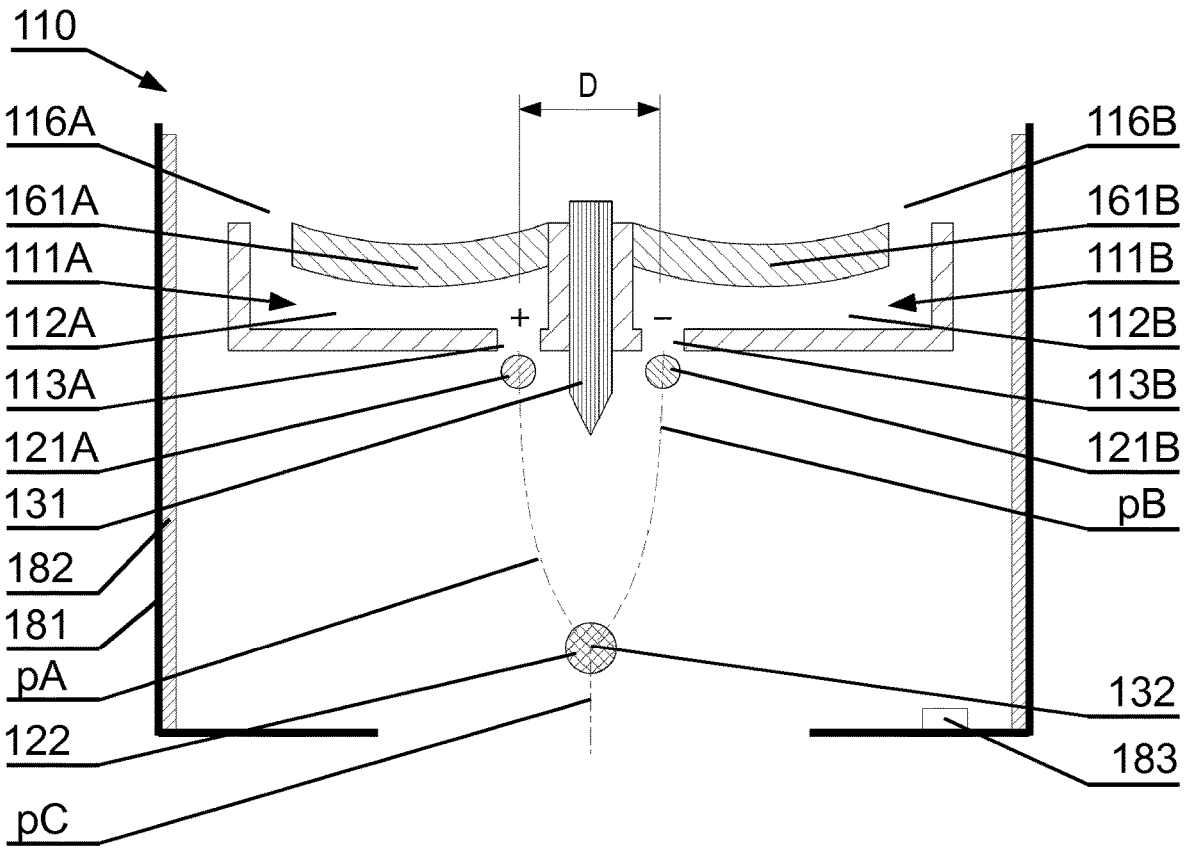
FIG. 3 shows schematically a second variant of a first embodiment.

An first example embodiment of the inkjet printing head 100 according to the invention is shown in detailed cross-sectional views in a first variant in FIG. 2 and in a second variant in FIG. 3.

The variants shown in FIGS. 2 and 3 differ by the positioning of the piezoelectric drop generating and propelling devices 161A, 161B—in the variant shown in FIG. 2 they are arranged in parallel to the direction of discharging drops, while in the variant shown in FIG. 3 they are arranged in perpendicular to the direction of discharging drops. The particular arrangement can be selected depending on the desired shape and available spacing within the printing head. Moreover, as shown in FIG. 2, the connection point 132 is located within the reaction chamber (which can be defined by the cover 181 of the printing head, or another enclosure within the printing head), while in FIG. 3 the connection point 132 is located outside the cover 181. The location of the connection point 132 is independent on the positioning of the drop generating and propelling devices 161A, 161B.

The inkjet printing head 100 may comprise one or more nozzle assemblies 110, each configured to produce a combined drop 122 formed of two primary drops 121A, 121B ejected from a pair of nozzles 111A, 111B separated by a separator 131. The embodiment can be enhanced by using more than two nozzles. FIG. 1 shows a head with 8 nozzle assemblies 110 arranged in parallel to print 8-dot rows 191 on a substrate 190. It is worth noting that the printing head in alternative embodiments may comprise only a single nozzle assembly 110 or more or less than 8 nozzle assemblies, even as much as 256 nozzle assemblies or more for higher-resolution print.

Each nozzle 111A, 111B of the pair of nozzles in the nozzle assembly 110 has a channel 112A, 112B for conducting liquid from a reservoir 116A, 116B. At the nozzle outlet 113A, 113B the liquid is formed into primary drops 121A, 121B as a result of operation of drop generating and propelling devices 161A, 161B, preferably of a piezoelectric type. The nozzle outlets 113A, 113B are adjacent to a separator 131 having a downstream-narrowing cross-section (preferably in a shape of a longitudinal wedge or a cone) that separates the nozzle outlets 113A, 113B (in particular, at the plane of the nozzle endings) and thus prevents the undesirable contact between primary drops 121A and 121B prior to their full discharge from their respective nozzle outlets 113A and 113B. The primary drops 121A, 121B ejected from the nozzle outlets 113A, 113B move along respectively a first path pA and a second path pB along (or next to) the separator 131. At a connection point, which can be at the tip of the separator, or further downstream along the path, preferably within the reaction chamber, but possibly also outside the printing head, the primary drops 121A, 121B combine to form a combined drop 122, which travels along a combined drop path pC towards the surface to be printed. Therefore, the separator 131 functions as means for preventing the first primary drop 121A to combine with the second primary drop 121B close to the nozzle outlets 113A, 113B, such as to prevent the clogging. In addition, the separator 131 may also function as means for controlling the flight of the primary drops 121A, 121B to allow the first primary drop 121A to combine with the second primary drop 121B at the connection point 132 into the combined drop 122.

The paths pA and pB join each other at the connection point 132 due to the fact that the primary drops 121A, 121B are charged with opposite charges. For example, the first primary drop 121A is charged with a positive charge and the second primary drop 121B is charged with a negative charge, or vice versa. The amount of the charge is selected for the drops depending on the type of liquids, the drop size, the speed of flight and the desired location of the connection point 132 (preferably, within the printing head, but possibly also outside the printing head), such as to achieve low speed of collision of the drops at the connection point.

The charging can be effected by pre-charging the liquids stored in the liquid reservoirs 116A, 116B (but such as not to cause electrochemical reaction within the reservoirs). The charging can be also effected by charging devices located within the nozzles 111A, 111B.

The separator may form an electrically isolating plate that isolates electrically the liquid reservoirs 116A, 116B, the nozzles 111A, 111B and the nozzle outlets 113A, 113B.

The separator is a recommended, but not an essential element of the printhead. For applications in stabilized, clean environment, the printhead without the separator could be applied as well, as shown in the second embodiment in FIG. 4.

The distance D between the nozzle outlets 113A, 113B, measured between their axes in the plane of the outlets, is larger than the sum of the diameters of the primary drops 121A, 121B exiting the nozzle outlets. This provides a minimum distance that the primary drops 121A, 121B must travel in the plane of the nozzle outlets before they collide, which is beneficial for controlling the parameters of the path of flight and facilitates coalescence after the primary drops 121A, 121B combine to form the combined drop 122 in a distance from the nozzles outlets necessary to avoid their possible clogging with the residue of the combined drop substance.

The combined drop 122, during movement along the combined drop path pC starting from the connection point is distanced from the elements of the printing head. The coalescence process takes some time while the whole substance—consisting at first of two substrates which start to mix—keeps moving away from the components of the printing head towards the printed product. It means that in fact the combined drop, where the diffusion of two substrates reaches the stage allowing the chemical reaction between primary substrates to get started, is formed already after losing the contact with elements of the printing head in spite of the fact primary drops can be guided by such elements towards the connection point. There are possible various turbulences within the combined drop and the combined drop will not have a perfectly round shape from the beginning. Therefore, for the sake of clarity, it can be said that the combined drop is distanced from the elements (i.e. walls of the elements) of the printing head during movement along the combined drop path pC starting from the connection point after traveling some short distance, for example a distance of one diameter of the combined drop 122. The same time the combined drop path pC is distanced from the elements of the printing head by a distance larger than half the diameter of the combined drop 122. Therefore, the combined drop, after being formed, does not touch any element of the printing head, which minimizes the risk of clogging of the printing head by the material of the combined drop. Such clogging might result from residue build up of the combined, reacted substance, which might be deposited within the printing head in case of undesired contact between combined, subject to solidification reaction substance and the elements of the printing head. The printing head is therefore constructed such that the combined drop does not touch any element of the printing head other that the element that guides the primary drops towards the connection point (at which the contact with the combined drop is effected only at the very beginning of the combined drop path). Once the combined drop separates from the guiding element, it does not come into contact with the other elements of the printing head. Therefore, once the chemical reaction has been initiated in the reaction chamber and continues during the movement of the combined drop along its path, the combined drop does not contact any element of the printing head. These relationships hold for the other embodiments as well.

The liquids supplied from the two reservoirs 116A, 116B are a first liquid (preferably an ink) and a second liquid (preferably a catalyst for initiating curing of the ink). This allows initiation of a chemical reaction between the first liquid of the first primary drop 121A and the second liquid of the second primary drop 121B for curing of the ink in the combined drop 122 before it reaches the surface to be printed, so that the ink may adhere more easily to the printed surface and/or cure more quickly at the printed surface.

The chemical reaction is initiated at the connection point 132 (at which the first path crosses with the second path) within a reaction chamber, which is in this embodiment formed by the cover 181 of the print head.

For example, the ink may comprise acrylic acid ester (from 50 to 80 parts by weight), acrylic acid (from 5 to 15 parts by weight), pigment (from 3 to 40 parts by weight), surfactant (from 0 to 5 parts by weight), glycerin (from 0 to 5 parts by weight), viscosity modifier (from 0 to 5 parts by weight). The catalyst may comprise azaridine based curing agent (from 30 to 50 parts by weight), pigment (from 3 to 40 parts by weight), surfactant (from 0 to 5 parts by weight), glycerin (from 0 to 5 parts by weight), viscosity modifier (from 0 to 5 parts by weight), solvent (from 0 to 30 parts by weight). The liquids may have a viscosity from 1 to 30 mPas and surface tension from 20-50 mN/m. Other inks and catalysts known from the prior art can be used as well. Preferably, the solvent amounts to a maximum of 10%, preferably a maximum of 5% by weight of the combined drop. This allows to significantly decrease the content of the solvent in the printing process, which makes the technology according to the invention more environmentally-friendly than the current CIJ technologies, where the content of solvents usually exceeds 50% of the total mass of the drop during printing process. For this reason, the present invention is considered to be a green technology.

The head construction is such that the nozzle outlets 113A, 113B are preferably separated from each other by the separator 131 and therefore the ink and the catalyst will not mix directly at the nozzle outlets 113A, 113B, which prevents the nozzle outlets 113A, 113B from clogging. Once the drops are combined to a combined drop 122, the risk of clogging of the separator tip 132 is minimized, as the separator is generally not to be touched during the drop flight and plays the role of the additional guarding of nozzle outlets. Moreover, in case of unwanted contact between the drop and the separator, the separator tip 132 has a small surface and the kinetic energy of the moving combined drop 122 is high enough to detach the combined drop 122 from the separator tip 132. Even if, due to differences in size or density or kinetic energy of the primary drops 121A, 121B, the combined drop 122 would not exit the head perpendicularly (as shown in FIG. 2) but at an inclined angle, that angle would be relatively constant and predictable for all drops, therefore it could be taken into account during the printing process. In other embodiments, other types of drop generating and propelling devices 161A, 161B may be used, such as thermal or valve type. In case of the valve the liquid would need to be delivered at adequate pressure.

The primary drops can be ejected from the nozzle outlets perpendicularly to the surface to be printed, as shown in FIG. 2. They may be also ejected at an angle less than 90 degrees, such as to initiate the direction of the paths pA, pB towards each other.

The separator 131 preferably has a length of its side wall measured from the nozzle outlet (i.e. from the plane of the nozzle outlet ending) to the separator tip 132, not shorter than the diameter of the primary drop 121A, 121B exiting the nozzle outlet 113A, 113B at that side wall. This prevents the primary drops 121A, 121B from merging before they exit the nozzle outlets 113A, 113B.

The liquids in the reservoirs 116A, 116B may be preheated. Increased temperature of working fluids (i.e. ink and catalyst) may also lead to improved coalescence process of primary drops and preferably increase adhesion and decrease the curing time of the combined drop 122 when applied on the substrate.

The separator 131 may be common for a plurality of nozzle assemblies 110. In alternative embodiments, each nozzle assembly 110 may have its own separator 131 and/or cover 181 or a sub-group of nozzle assemblies 110 may have its own common separator 131 and/or cover 181.

The printing head may further comprise a cover 181 which protects the head components, in particular the separator tip 132 and the nozzle outlets 113A, 113B, from the environment, for example prevents them from touching by the user or the printed substrate.

Moreover, the cover 181 may comprise heating elements 182 for heating the volume within the reaction chamber 181, i.e. the volume surrounding of the nozzle outlets 113A, 113B and the separator 131 to a predetermined temperature, for example from 40° C. to 60° C. (other temperatures are possible as well, depending on the parameters of the drops), such as to provide stable conditions for combining of the drops. A temperature sensor 183 may be positioned within the cover 181 to sense the temperature.

Second Embodiment

Figure 4:
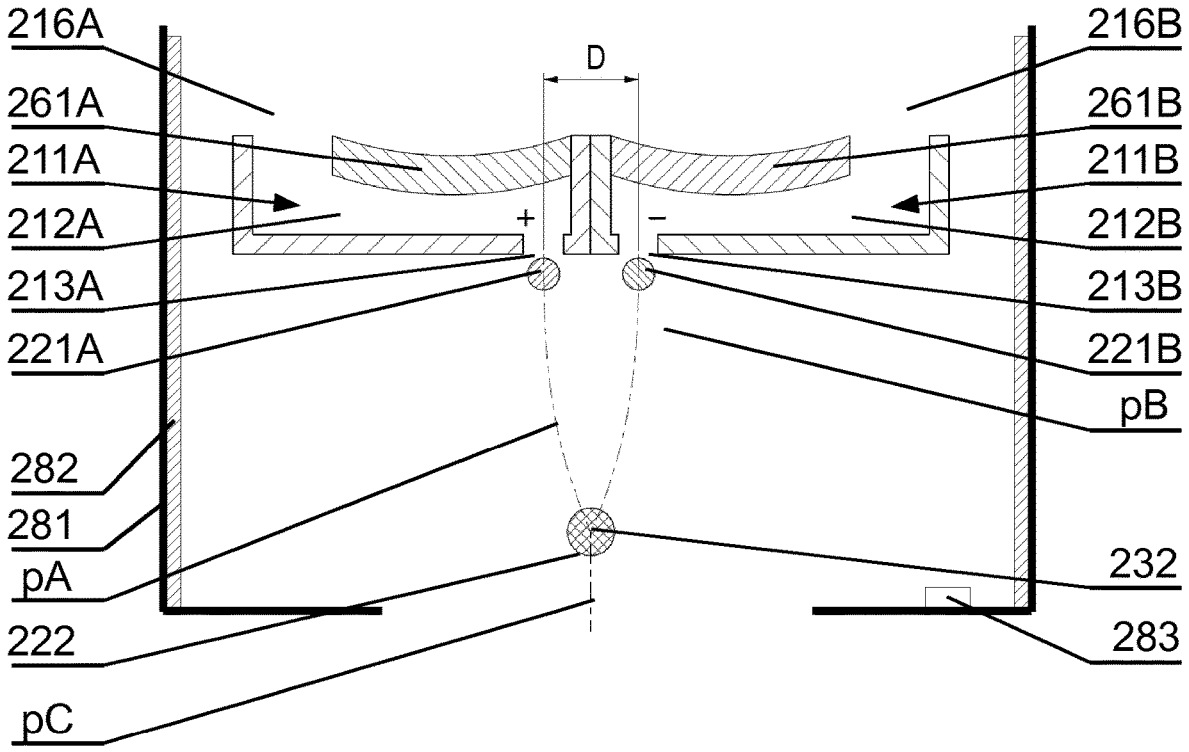
FIG. 4 shows schematically a second embodiment.

The second embodiment, shown in FIG. 4, differs from the first embodiment by not comprising the separator between the nozzle outlets. The elements marked with reference numerals 2*xx* are equivalent to the elements 1*xx* of the first embodiment.

In the second embodiment, the distance D between the nozzle outlets 213A, 213B, measured between their axes in the plane of the outlets, which is also larger than the diameters of the primary drops 221A, 221B exiting the nozzle outlets, provides, in addition to the advantages already discussed for the first embodiment, the advantage that the drops will not combine at the plane of the outlets, but at least slightly downstream, away from the outlets, therefore reducing the possibility of clogging of the nozzle outlets 213A, 213B.

Third Embodiment

Figure 5:
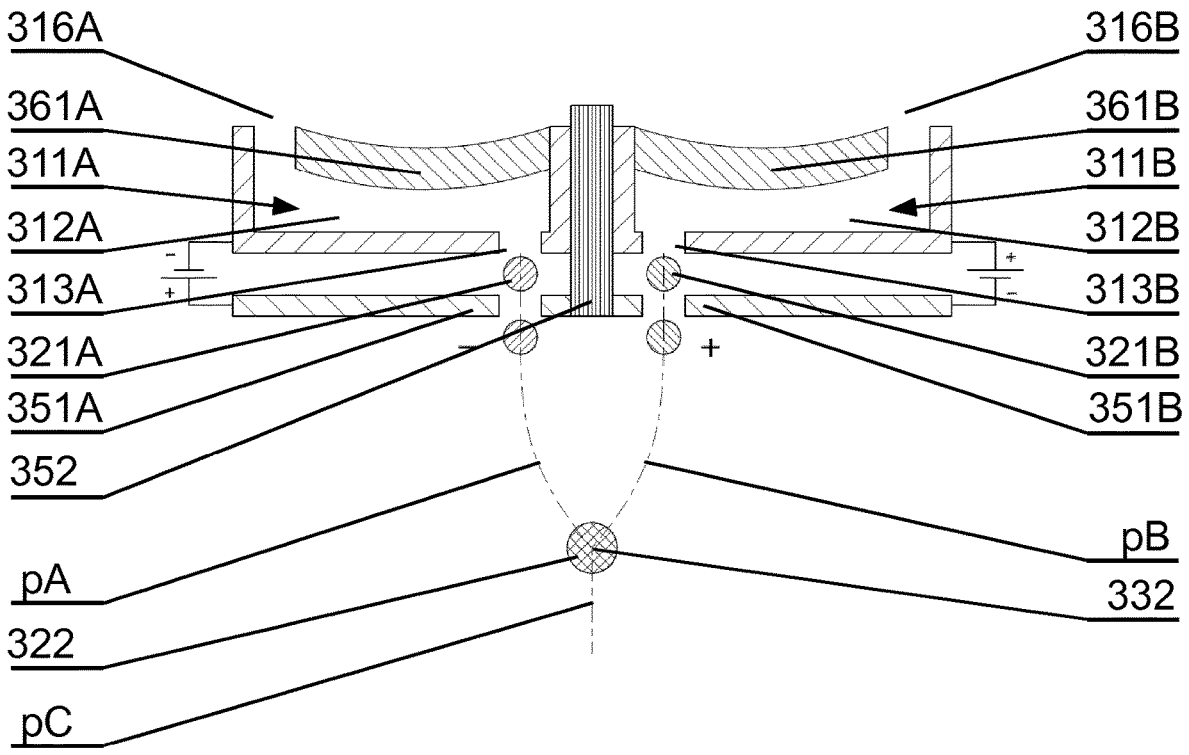
FIG. 5 shows schematically a first variant of a third embodiment.
Figure 6:
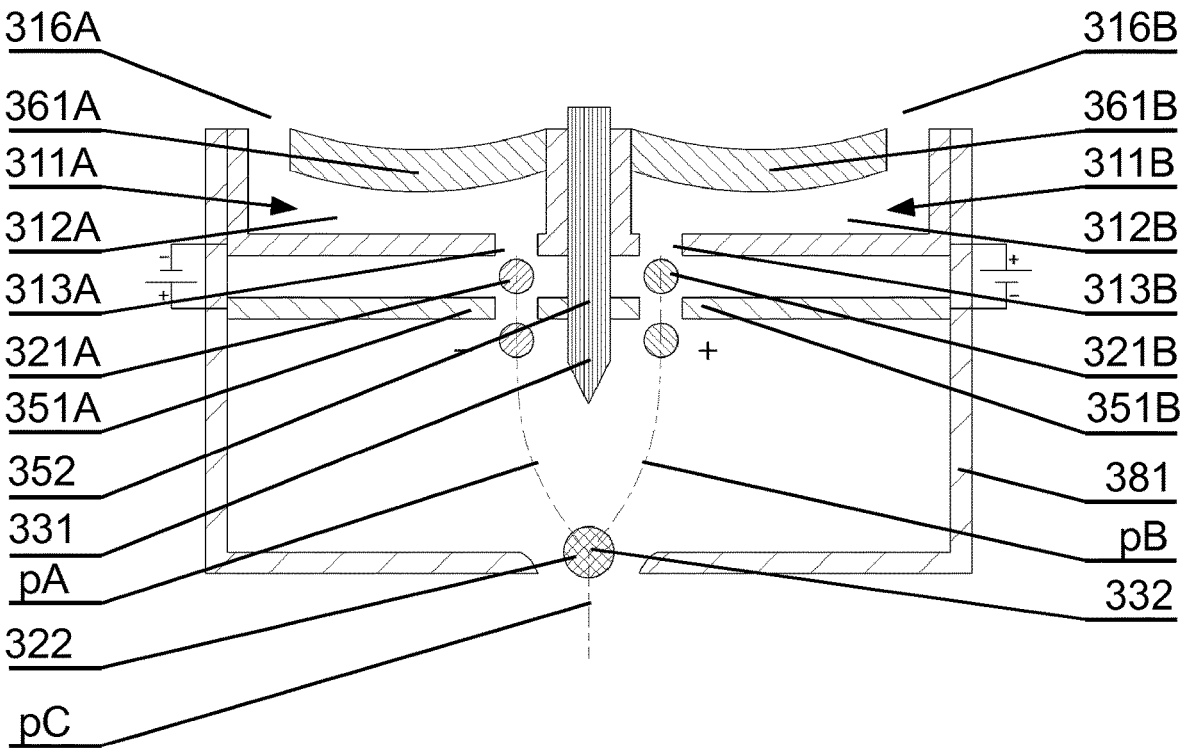
FIG. 6 shows schematically a second variant of a third embodiment.
Figure 7:
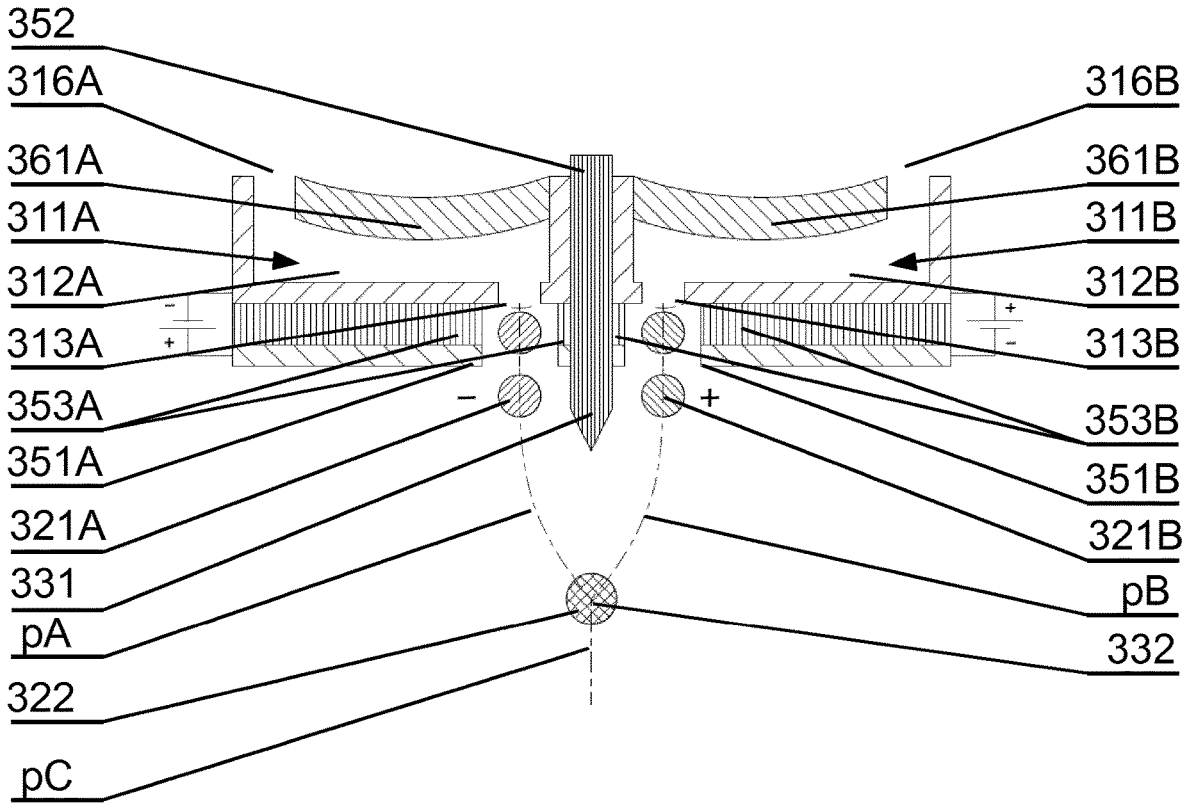
FIG. 7 shows schematically a third variant of a third embodiment.
Figure 8:
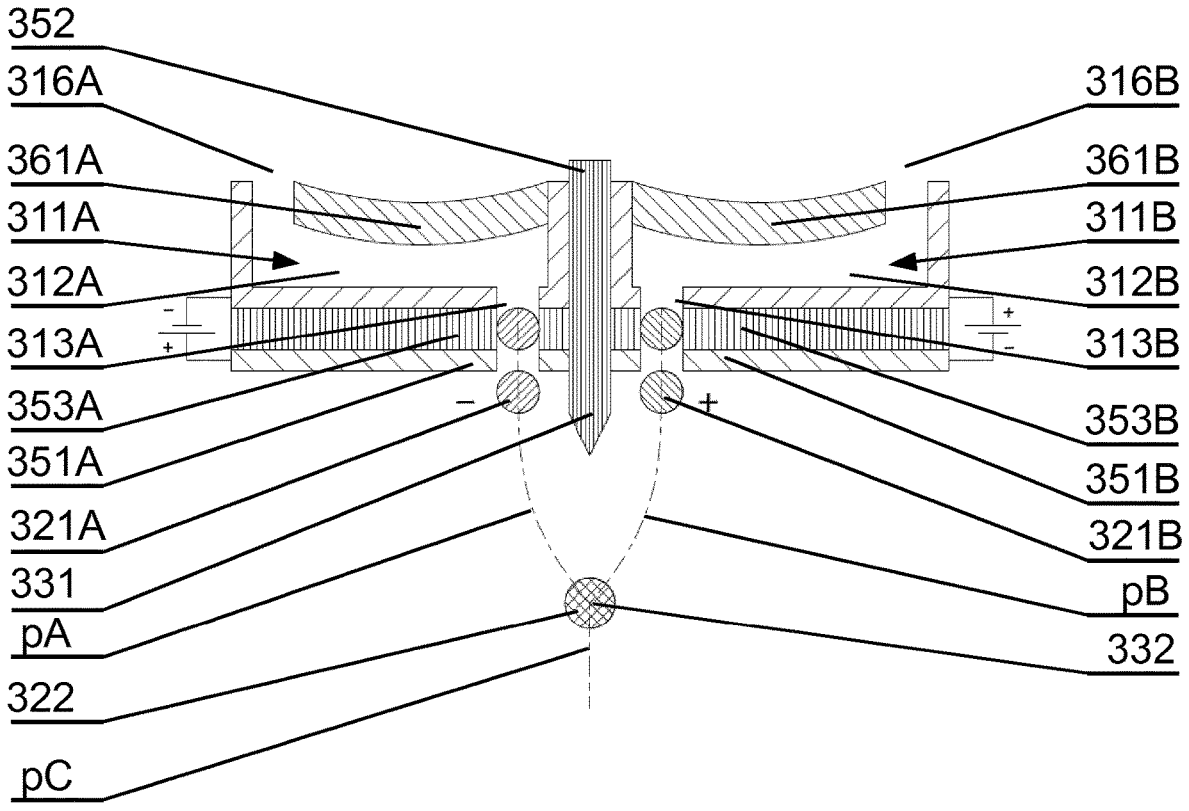
FIG. 8 shows schematically a fourth variant of a third embodiment.

The third embodiment is shown in a first variant in FIG. 5, in a second variant in FIG. 6, in a third variant in FIG. 7 and in a fourth variant in FIG. 8. It differs from the first embodiment by comprising additional means for charging the primary drops 321A, 321B after they exit the nozzle outlets 313A, 313B. The elements marked with reference numerals 3*xx* are equivalent to the elements 1*xx* of the first embodiment.

Charging plates 351A, 351B are provided downstream the paths of flight pA, pB of the primary drops, between the nozzle outlets 313A, 313B and the connection point 332. A first DC voltage source is connected between the first nozzle outlet 313A and the first charging plate 351A and a second DC voltage source is connected between the second nozzle outlet 313B and the second charging plate 351B, such that the second charging plate 351B has an electric potential opposite to the first charging plate 351A. A first capacitor is therefore formed between the first nozzle outlet 313A and the first charging plate 351A and a second capacitor is formed between the second nozzle outlet 313B and the second charging plate 351B.

In a first variant shown in FIG. 5, an electrically insulating separator plate 352 is positioned between the nozzle outlets 313A and 313B, and between the charging plates 351A and 351B. For clarity of drawing, the cover of the printing head has not been shown in FIG. 5.

In a second variant shown in FIG. 6, the electrically insulating separator plate 352 is integrated with a separator 331 with a downstream-narrowing cross section between the nozzle outlets, which has a function as described with respect to the first embodiment.

In a third variant shown in FIG. 7, the first charging plate 351A is separated from the first nozzle outlet 313A by a first electrically insulating separator 353A and the second charging plate 351B is separated from the second nozzle outlet 313B by a second electrically insulating separator 353B. This facilitates control of the charge applied to the primary drops 321A, 321B.

In a fourth variant shown in FIG. 8, the drop-guiding channels are formed along the nozzle outlets 313A, 313B, the electrically insulating separators 353A, 353B and the charging plates 351A, 351B (by having their diameters equal to the diameters of the generated primary drops 321A, 321B), which facilitate aligning the primary portion of the paths of flight to a desired trajectory.

Fourth Embodiment

Figure 9:
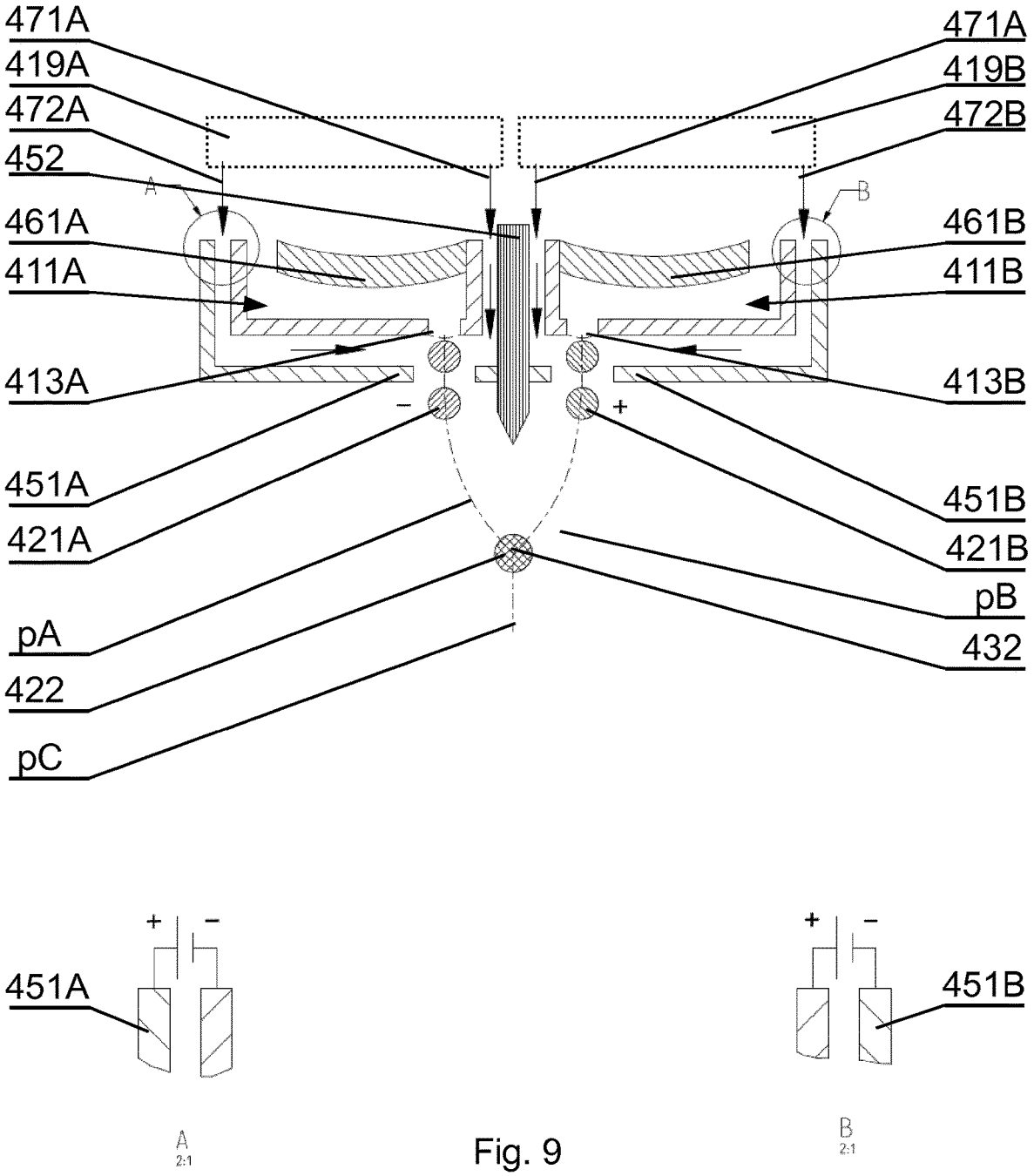
FIG. 9 shows schematically a first variant of a fourth embodiment.
Figure 10:
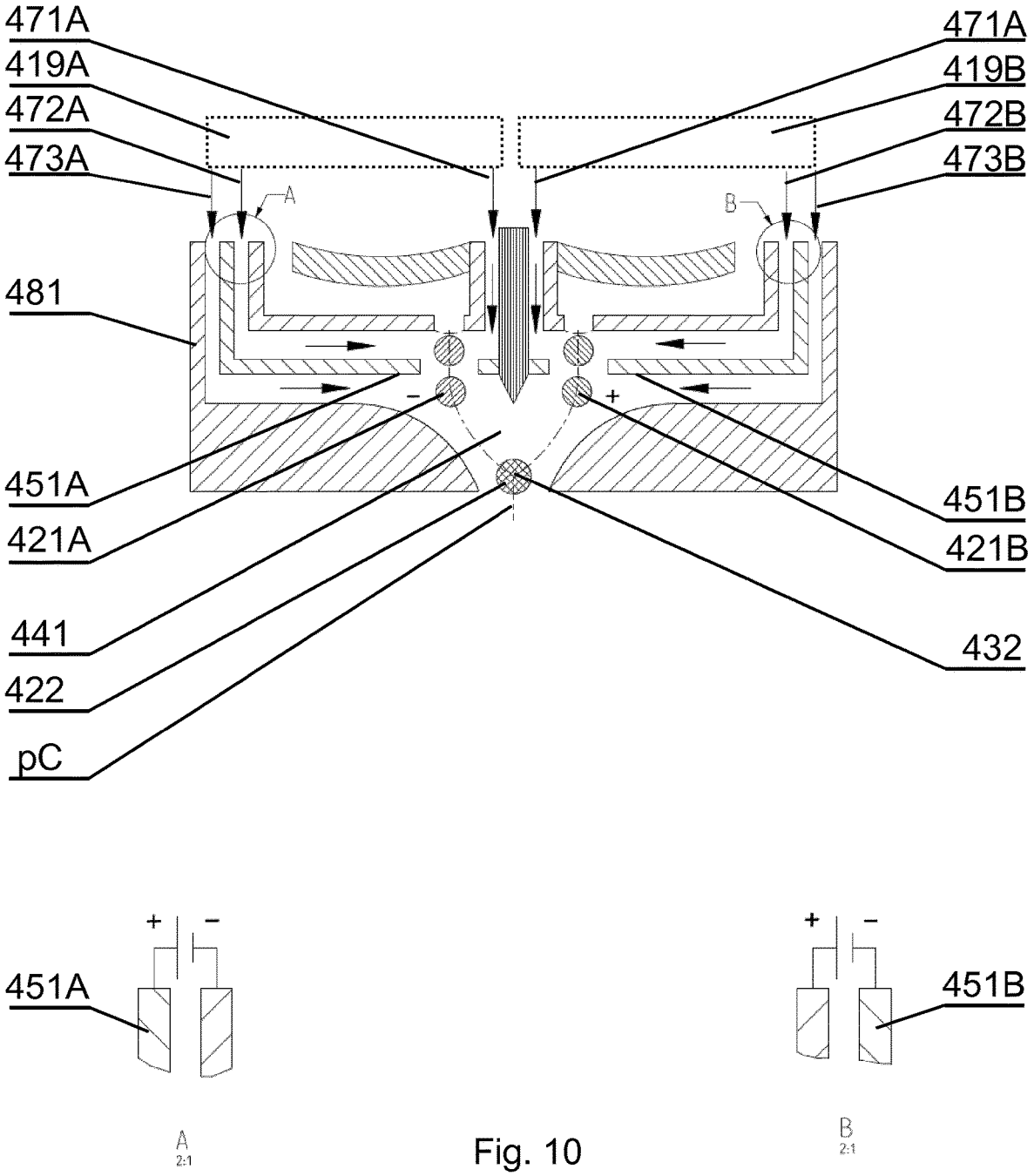
FIG. 10 shows schematically a second variant of a fourth embodiment.

The fourth embodiment is shown in a first variant in FIG. 9 and in a second variant in FIG. 10. It differs from the third embodiment by comprising additional gas-supplying nozzles 419A, 419B for guiding the primary drops 421A, 421B after they exit the nozzle outlets 413A, 413B. The elements marked with reference numerals 4*xx* are equivalent to the elements 3*xx* of the third embodiment.

In a first variant shown in FIG. 9, a gas-supplying nozzles 419A, 419B can be provided for blowing gas as shown by the arrows of FIG. 9 (such as air or nitrogen), preferably heated to a temperature higher than the ambient temperature or higher than the temperature of the liquids in the first and second reservoir (i.e. to a temperature higher than the temperature of the generated first and second drop), towards the paths of flight pA, pB, in order to decrease the curing time, increase the dynamics of movement of the drops and to blow away any residuals that could be formed at the nozzles outlets 413A, 413B and at the separator tip 432 (if present). The streams of gas can be generated in an intermittent manner, for at least the time of flight of the combined drop through the printing head from the connection point to the outlet of the printing head, which allows to control by means of the streams of gas the flight of the combined drop. Moreover, the streams of gas can be generated in an intermittent manner, for at least the time since the primary drops exit the nozzle outlets till the primary drops or the combined drop exit the outlet of the printing head, which allows to control by means of the streams of gas the flight of the primary drops and/or of the combined drop. Moreover, the streams of gas may continue to blow after the primary drops or the combined drop exit the printing head, for example even for a few seconds after the printing is finished (i.e. after the last drop is generated), in order to clean the components of the printing head from any residue of the first liquid, second liquid or their combination. The stream of gas may be also generated and delivered in a continuous manner.

First streams of gas 471A, 471B are guided between the electrically insulating separator 452 and the nozzles 411A, 411B. Second streams of gas 472A, 472B are guided between the charging plates 451A, 451B and the nozzles 411A, 411B. Both streams meet at the nozzle outlets 413A, 413B to guide and to facilitate discharging the primary drops 421A, 421B generated therein downwards the path of flight pA, pB.

The diameters of the outlets at the charging plates 451A, 451B can be made equal to the primary drop diameters to further facilitate the control of the drop discharge and the path of flight.

In a second variant shown in FIG. 10, the cover 181 forms an enclosure 441 outside the charging plates 451A, 452B, wherein third streams of gas 473A, 473B are guided between the charging plates 451A, 451B and the cover 181. The third streams of gas 473A, 473B facilitate control over the path of flight pA, pB of the primary drops on their way towards the connection point 432, which is located within the enclosure 441. Therefore, in that variant the control of the paths of flight pA, pB is achieved both by applying an electric charge to the primary drops 421A, 421B but also by guiding them via the streams of gas 473A, 473B.

Fifth Embodiment

Figure 11A:
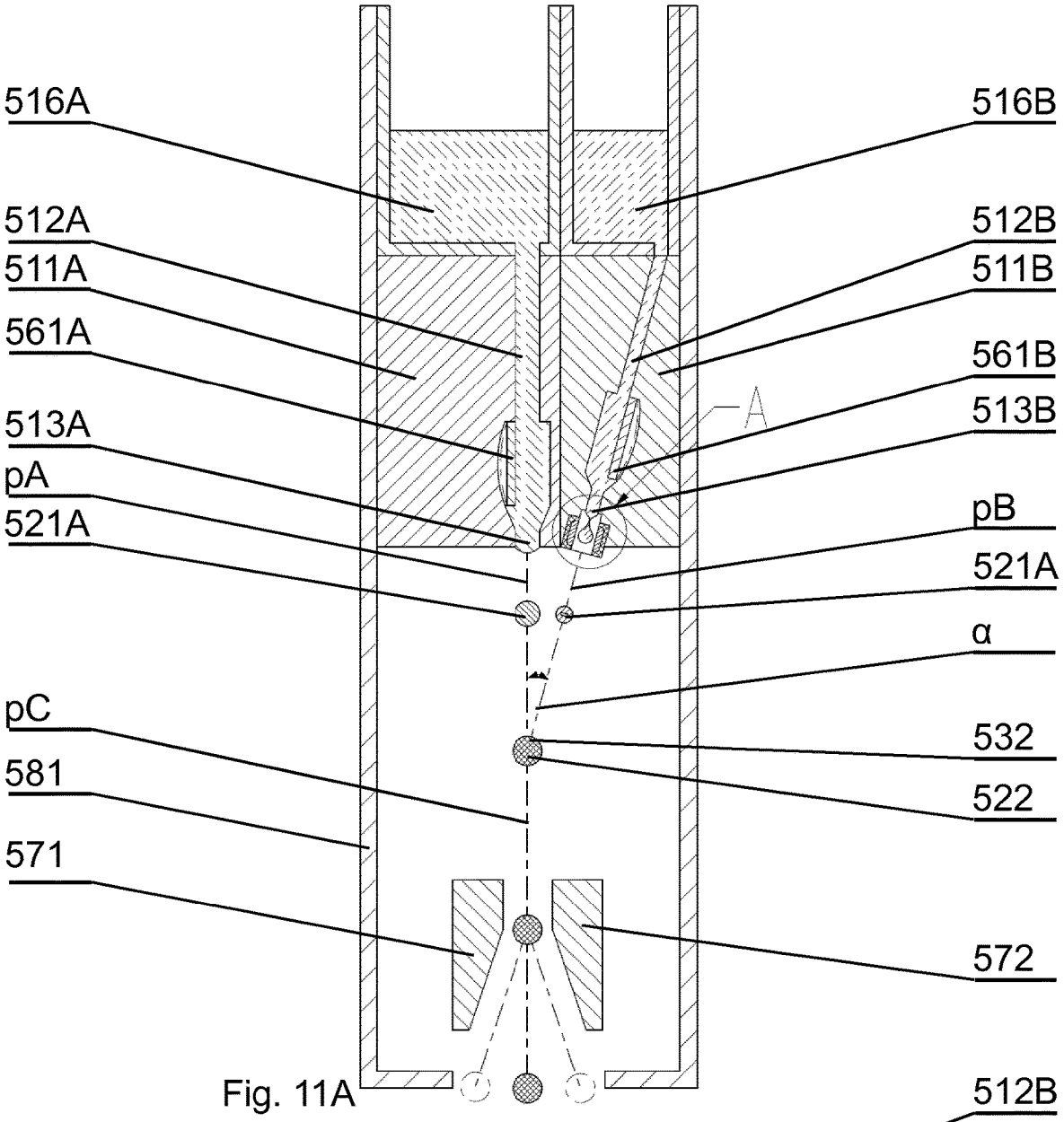
FIGS. 11A and 11B show schematically a fifth embodiment.
Figure 11B:
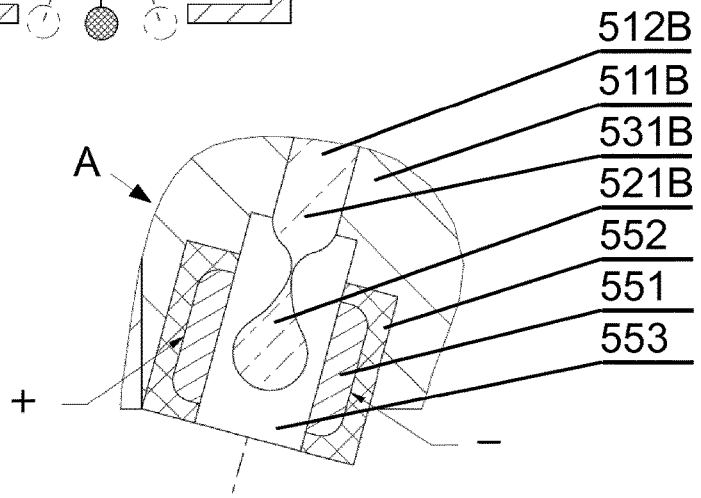

A fifth embodiment of the inkjet printing head according to the invention is shown in a detailed cross-sectional view in FIGS. 11A and 11B.

The inkjet printing head may comprise one or more nozzle assemblies, each configured to produce a combined drop 522 formed of two primary drops 521A, 521B ejected from a pair of nozzles 511A, 511B. The embodiment can be enhanced by using more than two nozzles.

Figure 12:
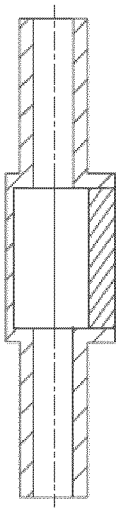
FIGS. 12, 13, 14 show schematically different devices for propelling a drop out of the nozzle.
Figure 13:
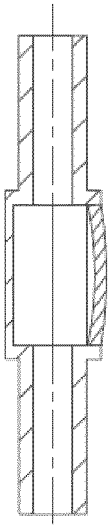
Figure 14:
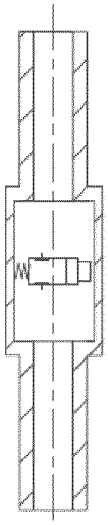

Each nozzle 511A, 511B of the pair of nozzles in the nozzle assembly 510 has a channel 512A, 512B for conducting liquid from a reservoir 516A, 516B. At the nozzle outlet 513A, 513B the liquid is formed into primary drops 521A, 521B and ejected as a result of operation of drop generating and propelling devices 561A, 561B shown in a more detailed manner on FIGS. 12, 13, 14. The drop generating and propelling devices may be for instance of thermal (FIG. 12), piezoelectric (FIG. 13) or valve (FIG. 14) type. In case of the valve the liquid would need to be delivered at some pressure. One nozzle 511A is arranged preferably in parallel to the main axis AA of the printing head—for that reason, it will be called shortly a "parallel axis nozzle". The other nozzle 511B is arranged at an angle $\alpha$ to the first nozzle 511A—for that reason, it will be called shortly an "inclined axis nozzle". Therefore, the first nozzle 511A is configured to eject the first primary drop 521A to move along a first path and the second nozzle 511B is configured to eject the second primary drop 521B to move along a second path. The nozzle outlets 513A, 513B are distanced from each other by a distance equal to at least the size of the larger of the primary drops generated at the outlets 513A, 513B, so that the primary drops 521A, 521B do not touch each other when they are still at the nozzle outlets 513A, 513B. This prevents forming of a combined drop at the nozzle outlets 513A, 513B and subsequent clogging the outlets 513A, 513B with a solidified ink. Preferably, the angle $\alpha$ is a narrow angle, preferably from 3 to 60 degrees, and more preferably from 5 to 25 degrees (which aids in alignment the two drops before coalescence). In such a case, the outlet 513A of the parallel axis nozzle 511A is distanced from the outlet of the printing head by a distance larger by "x" than the outlet 513B of the inclined axis nozzle 511B. The path of flight of the second drop 521B crosses with the path of flight of the first drop 521A at a connection point 532.

The first primary drop 521A and/or the second primary drop 521B is charged. In the example embodiment shown in FIG. 11A, the second primary drop 521B is charged by a charging system 550 located at the outlet 513B of the inclined axis nozzle 511B shown in FIG. 11B. Similar charging system 550 (not shown for clarity of the drawing) can be applied at the outlet 513A of the main axis nozzle 511A as well. Other charging means can be also used, such as charging means located at a larger distance from the nozzle outlet 513A, 513B, for charging at least one primary drop 521A, 521B in flight between the nozzle outlet 513A, 513B and the connection point 532. Furthermore, the liquid can be charged in the liquid reservoir 516A, 516B, i.e. the primary drop 521A, 521B may be generated from a charged liquid.

The charging system 550 comprises charging electrodes 551A, 551B separated from the nozzle 511B by an electric insulator 551A, 551B. The charging electrodes 551A, 551B are connected to a DC voltage source, which apply electrostatic charge to the primary drop 521B. Preferably, the charging electrodes 551A, 551B are located close to the nozzle outlet 513B, such that the primary drop 521B is charged while it separates from the stream of liquid in the nozzle channel 512B, so that once the primary drop 521B is separated, it already has the electric charge applied thereto. This facilitates control of the charging process in the environment of a charging chamber 553 next to the nozzle outlet 513B.

Therefore, electric charge is applied to the combined drop 522 from one of the first primary drop 521A and the second primary drop 521B when at least one of them or both are charged before the combination.

As a result, the combined drop 522 is charged accordingly to the charge applied to the first primary drop 521A and/or the second primary drop 521B. The liquid produced by combination of drops from the two reservoirs 516A, 516B is a product of a chemical reaction of a first liquid supplied from a first reservoir 516A and a second liquid supplied from the second reservoir 516B (preferably a reactive ink composed of an ink base and a catalyst for initiating curing of the ink base). The ink base may be composed of polymerizable monomers or polymer resins with rheology modifiers and colorant. The catalyst (which may be also called a curing agent) may be a cross-linking reagent in the case of polymer resins or polymerization catalyst in the case of polymerizable resins. The nature of the ink base and the curing agent is such that immediately after mixing at the connection point 532 a chemical reaction starts to occur leading to solidification of the mixture on the printed material surface, so that the ink may adhere more easily to the printed surface and/or cure more quickly at the printed surface.

For example, the ink may comprise acrylic acid ester (from 50 to 80 parts by weight), acrylic acid (from 5 to 15 parts by weight), pigment (from 3 to 40 parts by weight), surfactant (from 0 to 5 parts by weight), glycerin (from 0 to 5 parts by weight), viscosity modifier (from 0 to 5 parts by weight). The catalyst may comprise azaridine based curing agent (from 30 to 50 parts by weight), pigment (from 3 to 40 parts by weight), surfactant (from 0 to 5 parts by weight), glycerin (from 0 to 5 parts by weight), viscosity modifier (from 0 to 5 parts by weight), solvent (from 0 to 30 parts by weight). The liquids may have a viscosity from 1 to 50 mPas and surface tension from 20-50 mN/m. Other inks and catalysts known from the prior art can be used as well. Preferably, the solvent amounts to a maximum of 10%, preferably a maximum of 5% by weight of the combined drop. This allows to significantly decrease the content of the solvent in the printing process, which makes the technology according to the invention more environmentally-friendly than the current CIJ technologies, where the content of solvents usually exceeds 50% of the total mass of the drop during printing process. For this reason, the present invention is considered to be a green technology.

The liquids supplied by the two reservoirs 516A, 516B can be various substances, selected such that immediately after mixing a chemical reaction leading to transformation of the first and second liquid to a reaction product starts to occur. Thus chemical reaction transforming the first and second liquid into a reaction product is initiated within the reaction chamber within the printing head. Therefore, a chemical reaction is initiated before the combined drop leaves the printing head enclosure and reaches the printed material surface.

Typically, the ink drop will be larger than the catalyst drop.

The control of the path of flight of the primary drops 521A, 521B is controlled by setting at least one of:

- a particular speed of the primary drops (to provide adequate kinetic energy for the drops) ejected from the nozzle outlets;
- the size of the primary drops;
- the position of the nozzle outlets.

The parameters of the primary drops are preferably selected such that the kinetic energy of the drop ejected from the parallel axis nozzle is higher, preferably much higher (for example, at least 2 times, or at least 4 times, or at least 8 times, or at least 10 times, or at least 20 times, or at least 50 times, or at least 100 times) than the kinetic energy of the drop ejected from the inclined axis nozzle, at the connection point. Therefore, when the primary drops collide at the connection point, the combined drop travels along a path pC that is aligned substantially by the path pA of the primary drop. Preferably, the path pC of the combined drop 522 is altered no more than 20 degrees, preferably no more than 10 degrees, preferably no more than 5 degrees, from the axis of the path of flight pA of the first primary drop 521A.

Since the combined drop 522 is charged, its path pC can be further controlled by deflecting electrodes (which can be also called deflector plates) 571, 572.

The charging electrodes 551 and the deflecting electrodes 571, 572 can be designed in a manner known in the art from CIJ technology and therefore do not require further clarification on details.

As a result, the drop placement on the surface to be printed can be effectively controlled by the electrical parameters of the combined drop 522. The charge of the combined drop 522 may be controlled e.g. by setting the amount of charge applied to the first primary drop 521A and/or the second primary drop 521B.

Therefore, the drop charging and drop path deflecting as presented herein are similar to those known from existing CIJ technology. However, the presented printing head is of a drop-on-demand type, which does not require a gutter at path of flight of the drop towards to the printed substrate. This allows to deflect the path of the combined drop in two directions, not only one, like in typical CIJ printers. This feature allows to print larger areas in a more accurate manner when it comes to drop placement. Printing a number of lines can be also faster compared to CIJ technology by optimizing printing rasters (screens).

Preferably, the drops have different sizes, wherein the larger drop 521A is ejected from the parallel axis nozzle 511A, and the smaller drop 521B is ejected from the inclined axis nozzle 511B. For example, the larger drop 521A may be at least 2 times, or at least 4 times, or at least 8 times, or at least 10 times larger than the smaller drop 521B.

Preferably, the drops have different speeds, wherein the primary drop 521A is ejected from the parallel axis nozzle 511A with a higher speed than the primary drop 521B ejected from the inclined axis nozzle 511B. For example, the primary drop 521A may be ejected with a speed at least 2 times, or at least 4 times, or at least 8 times, or at least 10 times higher than the primary drop 521B. The speed of ejection of the second primary drop 521B can be set to a minimum speed allowable by the particular nozzle, for example 2 m/s. The speed of ejection of the first primary drop 521A can be set to a maximum speed allowable by the particular nozzle, for example 6 m/s or even higher.

For example, if the first primary drop 521A is four times larger than the second primary drop 521B and is ejected with a speed 3 times higher, it will have about 36 times higher kinetic energy. Thus the path of flight pC of the combined drop towards the printed surface would not be substantially altered from the path of flight pA of the first primary drop. Thanks to this feature slight changes in the way the first primary drop and the second primary drop would collide with each other at the connection point would not substantially change the path of flight of the combined drop, which would remain consistently repeatable, providing the high accuracy drop placement of the printed surface.

The position of the nozzle outlets may be regulated in order to fine-tune the position of the connection point, so that the drops collide in a manner such that the path of flight of the combined drop is most closely aligned to the path of flight of the parallel axis primary drop 521A.

The primary drops are preferably combined within the head, i.e. before the drops leave the outlet 585 of the head.

The process of generation of primary drops 521A, 521B is controlled by a controller of the drop generating and propelling devices 561A, 561B (not shown in the drawing for clarity), which generates trigger signals and controls the time of ejection of the drops. The primary drops are therefore generated on demand, in contrast to CIJ technology where a continuous stream of drops is generated at nozzle outlets. Each of the generated primary drops is then directed to the surface to be printed, in contrast to CIJ technology where only a portion of the drops is output and the other drops are fed back to a gutter.

In yet another embodiment, more than two primary drops may be generated, i.e. the combined drop 522 may be formed by coalescence (simultaneous or sequential) of more than two drops, e.g. three drops ejected from three nozzles, of which at least two have their axes inclined with respect to the desired axis of flow $A_C$ of the combined drop 522.

The axis of flow $A_C$ of the combined drop 522 is preferably the main axis of the printing head, but it can be another axis as well. The printing head may comprise additional means for improving drop placement control.

Furthermore, the printing head may comprise means for speeding up the curing of the combined drop 522 before it leaves the printing head, e.g. a UV light source (not shown in the drawing) for affecting a UV-sensitive curing agent in the combined drop 522.

The liquids in the reservoirs 516A, 516B may be preheated or the nozzle outlets can be heated by heaters installed at the nozzle outlets, such that the ejected primary drops have an increased temperature. The increased temperature of working fluids (i.e. ink and catalyst) may lead to improved coalescence process of primary drops and preferably increase adhesion and decrease the curing time of the combined drop 522 when applied on the substrate having a temperature lower than the temperature of the combined drop. The temperature of the ejected primary drops should therefore be higher than the temperature of the surface to be printed, wherein the temperature difference should be adjusted to particular working fluid properties. The rapid cooling of the coalesced drop after placement on the printing surface (having a temperature lower than the ink) increases the viscosity of the drop preventing drop flow due to gravitation.

The printing head further comprises a cover 581 which protects the head components, in particular the nozzle outlets 513A, 513B and the area around the connection point 532, from the environment, for example prevents them from touching by the user or the printed substrate. The cover 581 forms the reaction chamber. Because the connection point 532 is within the reaction chamber, the process of combining primary drops can be precisely and predictably controlled, as the process occurs in an environment separated from the surrounding of the printing head. The environment within the printing head is controllable and the environment conditions (such as the air flow paths, pressure, temperature) are known and therefore the coalescence process can occur in a predictable manner.

Moreover, the cover 581 may comprise heating elements (not shown in the drawing) for heating the volume within the cover 581, i.e. the volume surrounding of the nozzle outlets 513A, 513B and liquid reservoirs 516A, 566B to a predetermined temperature elevated in respect to the ambient temperature, for example from 40° C. to 80° C. (other temperatures are possible as well, depending on the parameters of the drops), such as to provide stable conditions for combining of the drops. A temperature sensor may be positioned within the cover 581 to sense the temperature. The higher temperature within the printing head facilitates better mixing of coalesced drop by means of diffusion. Additionally, the increased temperature increases the speed of chemical reaction starting at the moment of mixing. Ink reacting on the surface of printed material allows for better adhesion of the printed image.

Sixth Embodiment

Figure 15:
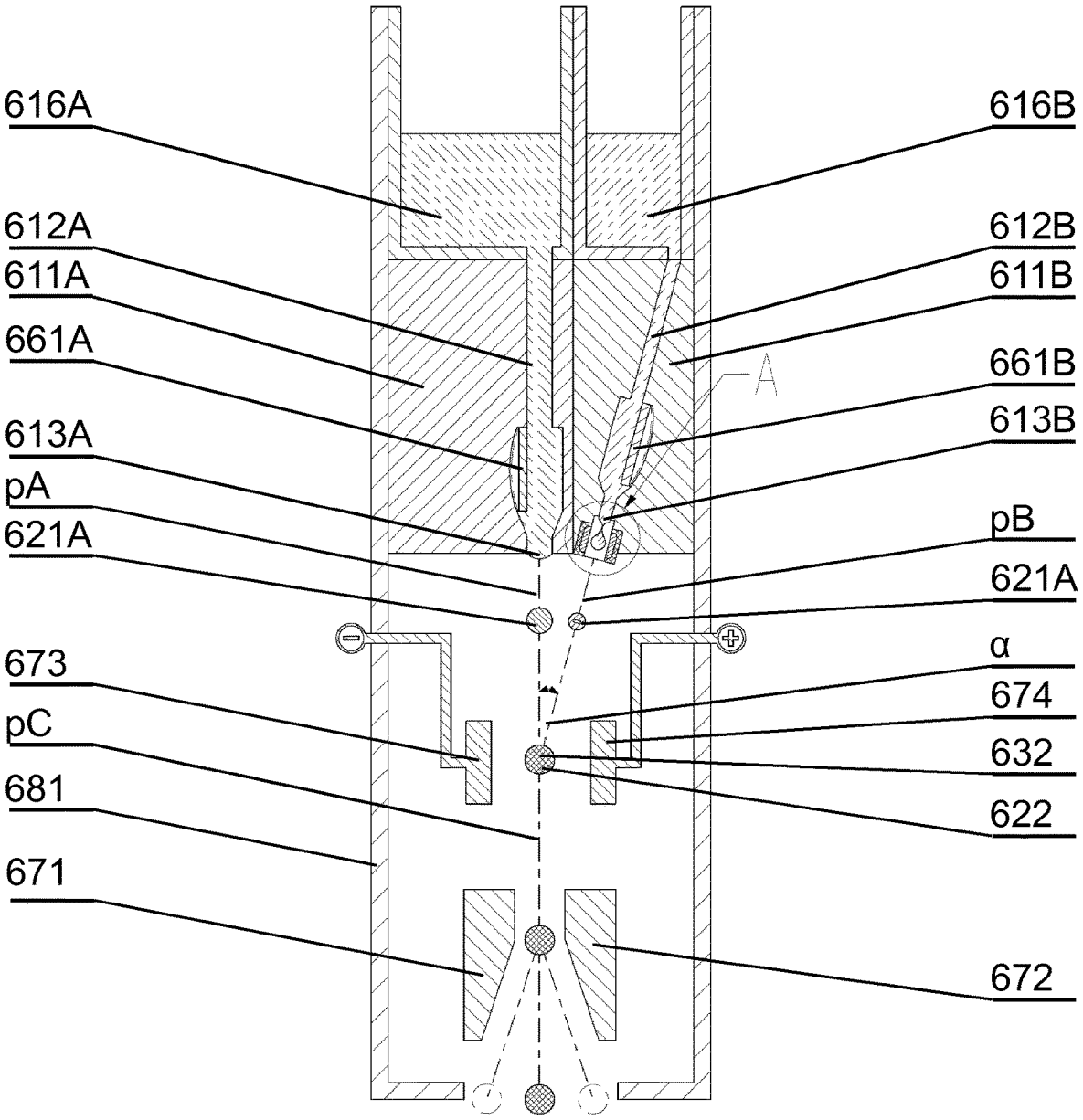
FIG. 15 shows schematically a sixth embodiment.

A seventh embodiment of the inkjet printing head according to the invention is shown in FIG. 15. It has most of its features in common with the fifth embodiment, with the following differences. The elements, having reference numbers starting with 6 (6*xx*) correspond to the elements of the sixth embodiment having reference numbers starting with 5 (5*xx*).

Deflecting electrodes 673, 674 are located along the path of the charged primary drop 621B. The deflecting electrodes 673, 674 are connected to a DC voltage source and thereby form a capacitor. The deflecting electrodes 673, 674 are used to deflect the path of the charged primary drop 621B. The deflecting electrodes 673, 674 can be designed in a manner known in the art from CIJ technology and therefore do not require further clarification on details.

In some applications, it may be important to control the path of flight of the primary drops 621A, 621B such that they collide at the connection point 632 at a particular angle $\alpha$. For example, the angle $\alpha$ may be dependent on the type of liquids forming the primary drops 621A, 621B—for some liquids, smaller collision angles $\alpha$ may be preferred than for other liquids. The deflecting electrodes 673, 674 at the path of flight of the charged primary drop increase the versatility of the printing head. The nozzles 611A, 61B may be located at a predefined arrangement, such that the primary drops are ejected along primary paths of flight pA, pB. At least one path of flight pA, pB of the at least one charged drop 621A, 621B can be then altered by the deflecting electrodes 673, 674 located along that path pA, pB, so that a desired collision angle α is obtained at the connection point.

In case both primary drops 621A, 621B are charged, two sets of the deflecting electrodes may be used, each located at separate positions along the respective paths pA, pB.

Seventh Embodiment

Figure 16:
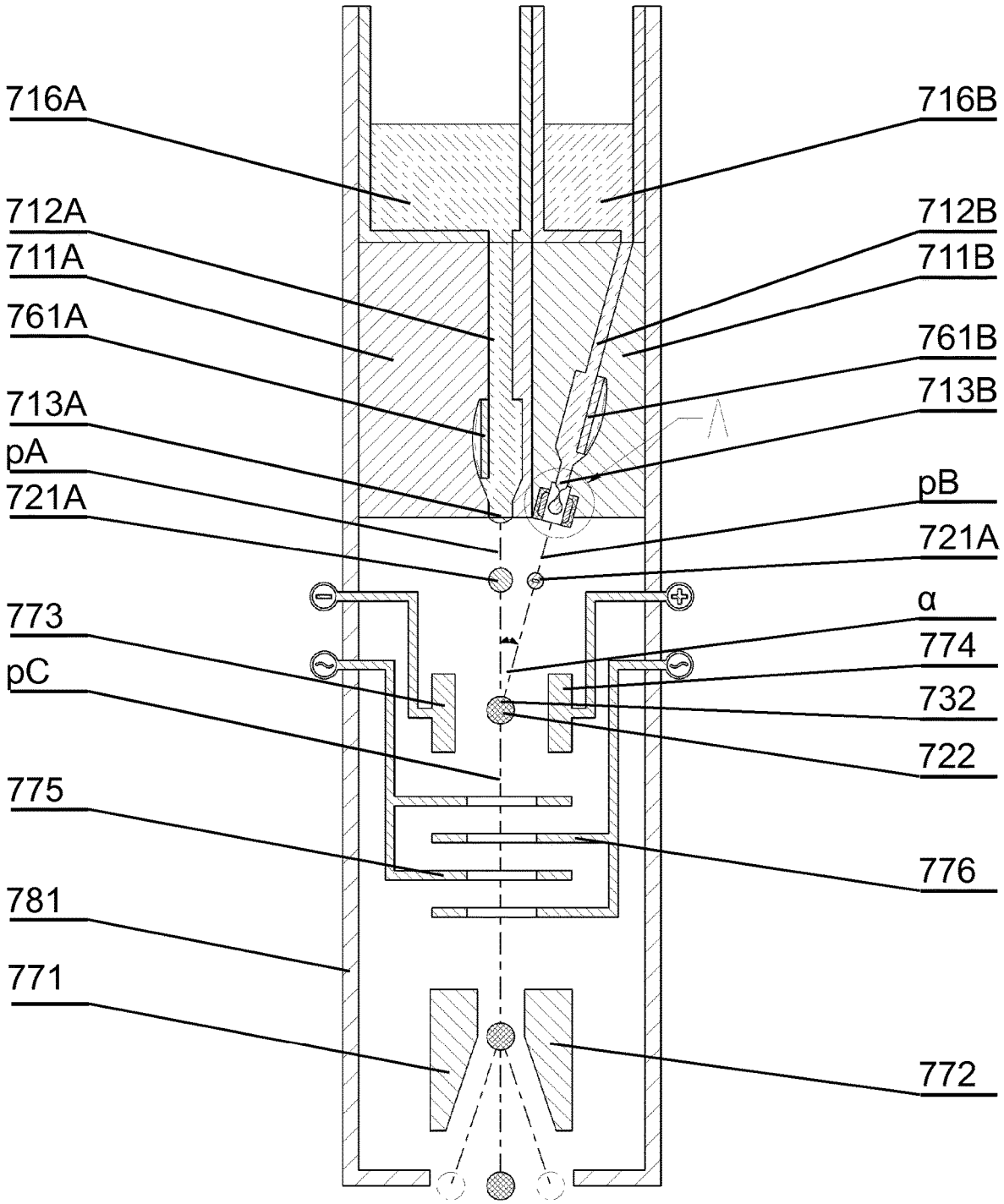
FIG. 16 shows schematically a seventh embodiment.

A seventh embodiment of the inkjet printing head according to the invention is shown in FIG. 16. It has most of its features in common with the sixth embodiment, with the following differences. The elements, having reference numbers starting with 7 (7*xx*) correspond to the elements of the seventh embodiment having reference numbers starting with 6 (6*xx*).

A set of comb-like accelerating electrodes 775, 776 connected to controllable DC or AC voltage sources, configured to increase the speed of flow of the charged combined drop 722 before it exits the printing head outlet. The speed can be increased in a controllable manner by controlling the AC voltage sources connected to the electrodes 775, 776, in order to achieve a desired combined drop 722 outlet speed, to e.g. control the printing distance, which can be particularly useful when printing on uneven substrates. The set of accelerating electrodes 775, 776 should be placed at a distance from the deflecting electrodes 773, 774 which is large enough so that the electric fields generated by the electrodes do not interfere their operation in undesired manner. The distance between the accelerating electrodes and the number of accelerating electrode pairs where the combined drop 722 remains under the influence of accelerating force depends on the size of the combined drop 722 and the required increase of its speed. For some industrial printing applications a set of AC capacitors might be needed in order to preferably double or triple the combined drop speed, for example from 6 m/s to 12 m/s measured at the outlet of the head. It is also possible to mount the DC electrodes as an accelerating unit.

Use of accelerating electrodes allows to eject primary drops from nozzle outlets with relatively small velocities, which helps in the coalescence (which occurs at certain optimal collision parameters depending on: relative speed of drops, their given surface tension, size, temperature etc.), and then to accelerate the combined drop in order to achieve desired printing conditions.

Eighth Embodiment

Figure 17:
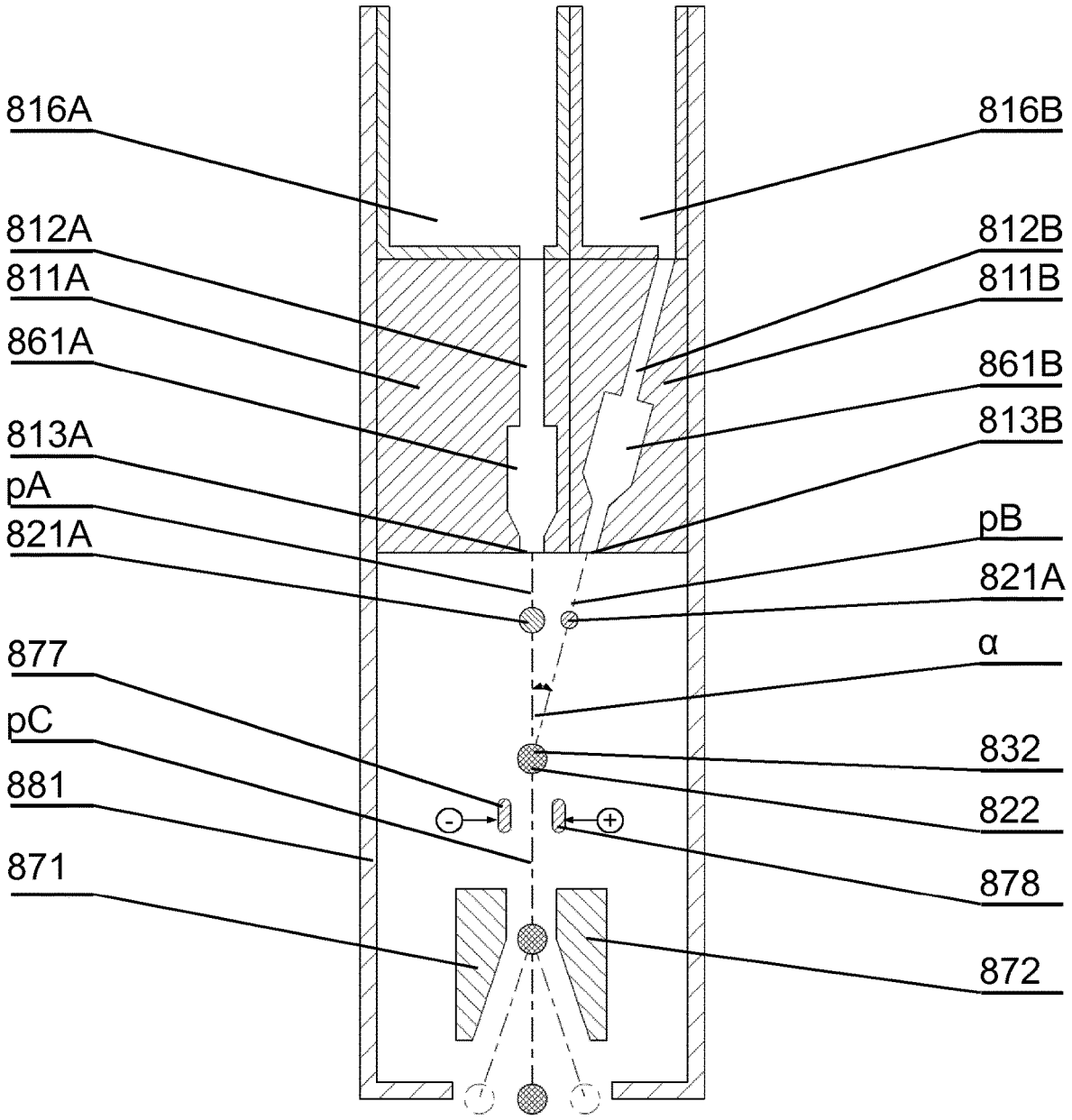
FIG. 17 shows schematically an eighth embodiment.

An eighth embodiment of the inkjet printing head according to the invention is shown in FIG. 17. It has most of its features in common with the fifth embodiment, with the following differences. The elements, having reference numbers starting with 8 (8*xx*) correspond to the elements of the fifth embodiment having reference numbers starting with 5 (5*xx*).

Charging electrodes 877, 878 are located along the path of the combined drop 822. For example, the charging electrodes 877, 878 can be connected to a DC voltage source to form an electric arc between the electrodes. The charging electrodes 877, 878 may function as an electron gun. As a result, the combined drop 822 is charged in flight along its path pC. The combined drop pC can be formed of electrically-neutral (i.e. non-charged) primary drops 821A, 821B and then the combined drop 822 can be charged in flight to allow its control by the deflecting electrodes. Alternatively, the combined drop pC can be formed of at least one charged primary drop (e.g. according to the first embodiment) and then the charge of the combined drop 822 may be altered in flight by the charging electrodes 877, 878.

Further Embodiments

It shall be noted that the drawings are schematic and not in scale and are used only to illustrate the embodiments for better understanding of the principles of operation.

The present invention is particularly applicable for high resolution DOD inkjet printers. However, the present invention can be also applied to low resolution DOD based on valves allowing to discharge drops of pressurized ink.

The environment in the reaction chamber may be controlled by controlling at least one of the following parameters: chamber temperature (e.g. by means of a heater within the reaction chamber), velocity of the streams of gas (e.g. by controlling the pressure of gas delivered), gas components (e.g. by controlling the composition of gas delivered from various sources), electric field (e.g. by controlling the electrodes), ultrasound field (e.g. by providing additional ultrasound generators within the reaction chamber, not shown in the drawings), UV light (e.g. by providing additional UV light generators within the reaction chamber, not shown in the drawings), etc.

A skilled person will realize that the features of the embodiments described above can be further mixed with features known from other DOD printing heads. For example there can be more than two nozzles directing more than two primary drops in order to form one combined drop by means of using the same principles of discharging, guiding, forming, also by means of controlled coalescence, and accelerating drops within the print head as described above.

The invention claimed is:

1. A drop-on-demand printing method comprising performing the following steps in a printing head:

discharging a first primary drop of a first liquid from a first nozzle outlet to move along a first path of flight (pA) with a first speed;

discharging a second primary drop of a second liquid from a second nozzle outlet to move along a second path of flight (pB) with a second speed, lower than the first speed, wherein the second path of flight (pB) is inclined with respect to the first path of flight (pA) along an axis inclined at an angle (a) from 3 to 60 degrees and crosses the first path of flight (pA) at a connection point;

controlling flight of the first primary drop and the second primary drop to combine the first primary drop with the second primary drop into a combined drop at the connection point so that a chemical reaction is initiated between the first liquid of the first primary drop and the second liquid of the second primary drop;

applying electric charge to the combined drop to form a charged combined drop;

wherein the path of flight (pC) of the charged combined drop is altered no more than 20 degrees from the axis of the path of flight (pA) of the first primary drop; and controlling the path of flight (pC) of the charged combined drop with applied electric charge by deflecting electrodes.

2. The method according to claim 1 wherein the first primary drop has at the connection point a kinetic energy higher than the second primary drop.

3. The method according to claim 1, comprising applying electric charge to the combined drop by charging at least one of: the first primary drop to form a first charged primary drop and the second primary drop to form a second charged primary drop.

4. The method according to claim 3, comprising charging at least one of: the first primary drop between the first nozzle outlet and the connection point and the second primary drop between the second nozzle outlet and the connection point.

5. The method according to claim 4, comprising charging at least one of: the first primary drop at the first nozzle outlet and the second primary drop at the second nozzle outlet while the first and the second primary drops are in contact with the liquid within a channel of the at least one of the first nozzle outlet and the second nozzle outlet.

6. The method according to claim 3, further comprising deflecting at least one of: the first path of flight (pA) of the first charged primary drop and the second path of flight (pB) of the second charged primary drop by deflecting electrodes.

7. The method according to claim 1, further comprising accelerating the charged combined drop by accelerating electrodes.

8. The method according to claim 1, comprising applying electric charge to the combined drop by charging the combined drop in flight.

9. The method according to claim 1, comprising discharging the first primary drop of a size larger than the second primary drop.

10. The method according to claim 1, comprising controlling timing of discharge of the first and second primary drops.

11. The method according to claim 1, comprising controlling a position of the first nozzle outlet with respect to a position of the second nozzle outlet.

12. The method according to claim 1, wherein the connection point is located within a reaction chamber defined by a cover.

13. The method according to claim 12, further comprising controlling at least one of the following parameters within the reaction chamber: chamber temperature, electric field, ultrasound field, UV light, a stream of gas directed towards an enclosure outlet of the printing head.

14. A drop-on-demand printing head comprising: a nozzle assembly comprising:

a first nozzle connected through a first channel with a first liquid reservoir with a first liquid and having a first drop generating and propelling device for forming on demand a first primary drop of the first liquid and discharging the first primary drop to move along a first path of flight (pA) with a first speed; and a second nozzle connected through a second channel with a second liquid reservoir with a second liquid and having a second drop generating and propelling device for forming on demand a second primary drop of the second liquid and discharging the second primary drop to move along a second path of flight (pB) with a second speed, lower than the first speed, wherein the second path of flight (pB) is inclined with respect to the first path of flight (pB) along an axis inclined at an angle (a) from 3 to 60 degrees and crosses the first path of flight (pA) at a connection point;

means for controlling the flight of the first primary drop and the second primary drop to combine the first primary drop with the second primary drop into a combined drop at the connection point so that a chemical reaction is initiated between the first liquid of the first primary drop and the second liquid of the second primary drop;

means for applying electric charge to the combined drop;

wherein the path of flight (pC) of the combined drop is altered no more than 20 degrees from the axis of the path of flight (pA) of the first primary drop; and deflecting electrodes for controlling the path of flight (pC) of the combined drop.

15. The printing head according to claim 14, wherein the first primary drop has at the connection point a kinetic energy higher than the second primary drop.

16. The printing head according to claim 14, comprising charging electrodes for charging at least one of: the first primary drop and the second primary drop.

17. The printing head according to claim 16, wherein the charging electrodes are positioned between an outlet of the first nozzle and of the second nozzle and the connection point.

18. The printing head according to claim 17, comprising wherein the charging electrodes are located at the first and second nozzle outlets to charge the first primary drop or the second primary drop while the first or second primary drop is in contact with the liquid within a channel of the first and second nozzles.

19. The printing head according to claim 14, further comprising deflecting electrodes for deflecting the first path of flight and the second path of flight (pA, pB) of a charged primary drop.

20. The printing head according to claim 14, further comprising accelerating electrodes for accelerating the charged combined drop.

21. The printing head according to claim 14, further comprising charging electrodes for applying electric charge to the charged combined drop by charging the combined drop in flight.

22. The printing head according to claim 14, wherein the first primary drop has a size larger than the second primary drop.

23. The printing head according to claim 14, further comprising a controller for controlling timing of discharge of the first and second primary drops.

24. The printing head according to claim 14, further comprising means for controlling the relative position of outlets of the first and second nozzles.

25. The printing head according to claim 14, further comprising a source of a stream of gas directed towards an outlet of the printing head.

26. The printing head according to claim 14, wherein the connection point is located within a reaction chamber defined by a cover.

27. A drop-on-demand printing method comprising performing the following steps in a printing head:

discharging a first primary drop of a first liquid having a first electric charge to move along a first path of flight; and discharging a second primary drop of a second liquid having a second electric charge which is opposite to the first charge to move along a second path of flight;

wherein the first charge and the second charge are selected such that the first and second primary drops attract each other in flight and combine to form a combined drop at a connection point before reaching a printed surface.

28. A drop-on-demand printing head comprising: a nozzle assembly comprising:

a first nozzle connected through a first channel with a first liquid reservoir with a first liquid and having a first drop generating and propelling device for forming on demand a first primary drop of the first liquid and discharging the first primary drop to move along a first path of flight;

a second nozzle connected through a second channel with a second liquid reservoir with a second liquid and having a second drop generating and propelling device for forming on demand a second primary drop of the second liquid and discharging the second primary drop to move along a second path of flight; and means for charging the first liquid forming the first primary drop with a first charge; means for charging the second liquid forming the second primary drop with a second charge which is opposite to the first charge;

wherein the first charge and the second charge are selected such that the first and second primary drops attract each other in flight and combine to form a combined drop at a connection point before reaching the printed surface.

* * * * *